US007596339B2

(12) United States Patent
Kawase et al.

(10) Patent No.: US 7,596,339 B2
(45) Date of Patent: Sep. 29, 2009

(54) IMAGE FORMING APPARATUS INCLUDING AN INTERCHANGEABLE ENGINE AND AN INTERCHANGEABLE PAPER FEEDING AND OUTPUTTING SYSTEM

(75) Inventors: Michio Kawase, Abiko (JP); Noriyoshi Chizawa, Moriya (JP); Masashi Oyumi, Abiko (JP); Shigeo Hata, Toride (JP); Yoshihito Osari, Chuo-ku (JP); Kiyoshi Okamoto, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 430 days.

(21) Appl. No.: 11/469,285

(22) Filed: Aug. 31, 2006

(65) Prior Publication Data

US 2007/0053715 A1 Mar. 8, 2007

(30) Foreign Application Priority Data

Sep. 6, 2005 (JP) ..... 2005-258385
Jul. 28, 2006 (JP) ..... 2006-205677

(51) Int. Cl.
*G03G 15/00* (2006.01)

(52) U.S. Cl. ..... 399/110

(58) Field of Classification Search ..... 399/107, 399/110, 111, 116, 121, 124
See application file for complete search history.

(56) References Cited

U.S. PATENT DOCUMENTS 4,569,582 A * 2/1986 Hyltoft ..... 399/77
5,184,178 A * 2/1993 Takayanagi et al. ..... 399/16
5,208,612 A * 5/1993 Obu et al. ..... 347/152
5,774,764 A * 6/1998 Toyokura et al. ..... 399/77
5,778,284 A * 7/1998 Kumar et al. ..... 399/111
5,850,581 A * 12/1998 Roller ..... 399/2
5,884,123 A * 3/1999 Stickney et al. ..... 399/107
6,308,027 B1 * 10/2001 Obu et al. ..... 399/110
6,721,535 B2 * 4/2004 Hatano ..... 399/396
2005/0286923 A1 * 12/2005 Kim ..... 399/75
2007/0053021 A1 * 3/2007 Osari et al. ..... 358/498

FOREIGN PATENT DOCUMENTS

JP 05-307281 A 11/1993
JP 06-035248 A 2/1994
JP 11-29233 A 2/1999
JP 2004-163547 A 6/2004

* cited by examiner

*Primary Examiner*—Robert Beatty
(74) *Attorney, Agent, or Firm*—Canon U.S.A. Inc., I.P. Division

(57) ABSTRACT

An image forming apparatus has a configuration in which a plurality of subsystems, each having a specific function, are interchangeably connected to a base platform. Each of the subsystems includes a plurality of units having a variety of different performances. A control unit is capable of control each of the subsystems so that the image forming apparatus flexibly provides functions that are tailored to individual users' requirements.

3 Claims, 26 Drawing Sheets

FIG. 20A

CONFIGURATION INFORMATION SENT FROM UNIT (SUBSYSTEM)

701

| | |
|---|---|
| 1 | UNIT ID |
| 2 | PROCESS SPEED (ps) 1: X1 mm/sec |
| 3 | COLOR MODE FOR ps 1 (C/BW/COMMON) |
| 4 | POWER CONSUMPTION OF UNIT FOR ps 1: x1 (W) |
| 5 | MATERIAL FOR ps 1: A |
| 6 | MATERIAL FOR ps 1: B |
| ⋮ | ⋮ |
| N | PROCESS SPEED (ps) 2: X2 mm/sec |
| N+1 | COLOR MODE FOR ps 2 (C/BW/COMMON) |
| N+2 | POWER CONSUMPTION OF UNIT FOR ps 2: x2 (W) |
| N+3 | MATERIAL FOR ps 2: C |
| ⋮ | ⋮ |
| M | PROCESS SPEED (ps) 3: X3 mm/sec |
| M+1 | COLOR MODE FOR ps 3 (C/BW/COMMON) |
| M+2 | POWER CONSUMPTION OF UNIT FOR ps 3: x3 (W) |
| M+3 | MATERIAL FOR ps 3: E |
| ⋮ | ⋮ |
| L | MINIMUM INTER-SHEET GAP: Y mm |

FIG. 20B

AVAILABLE ELECTRIC POWER INFORMATION SENT FROM POWER SUPPLY UNIT 90

702

| | |
|---|---|
| 1 | UNIT ID (POWER SUPPLY UNIT ID) |
| 2 | AVAILABLE ELECTRIC POWER: TT (W) |
| 3 | ELECTRIC POWER LINE DATA (5 V, 24 V, etc) |

FIG. 20C

CONFIGURATION INFORMATION SENT FROM IMAGE FORMATION CONTROL UNIT 160 (FIXED PART)

703

| | |
|---|---|
| 1 | CONFIGURATION INFORMATION (4D COLOR, 1D COLOR, BW) |
| 2 | ITOP PERIOD (COLOR) |
| 3 | ITOP-TO-SECONDARY TRANSFER PERIOD (COLOR) |

FIG. 21A

OPERATING INFORMATION SENT
FROM PRINTER ENGINE CONTROL UNIT 105

704

| | |
|---|---|
| 1 | PROCESS SPEED (ps) 1: Z1 mm/sec |
| 2 | COLOR MODE FOR ps 1 (C/BW/COMMON) |
| 3 | MATERIAL FOR ps 1: A |
| 4 | MATERIAL FOR ps 1: B |
| 5 | PPM FOR ps 1: XX ppm |
| ⋮ | ⋮ |
| N | PROCESS SPEED (ps) 2: Z2 mm/sec |
| N+1 | COLOR MODE FOR ps 2 (C/BW/COMMON) |
| N+2 | MATERIAL FOR ps 2: C |
| N+3 | PPM FOR ps 2: YY ppm |
| ⋮ | ⋮ |
| M | PROCESS SPEED (ps) 3: Z3 mm/sec |
| M+1 | COLOR MODE FOR ps 3 (C/BW/COMMON) |
| M+2 | MATERIAL FOR ps 3: D |
| M+3 | PPM FOR ps 3: ZZ ppm |
| | |
| L | NO SUPPORT MATERIAL 1: E |
| L+1 | COLOR MODE FOR NO SUPPORT MATERIAL 1 |
| L+2 | NO SUPPORT MATERIAL 2: F |
| L+3 | COLOR MODE FOR NO SUPPORT MATERIAL 2 |
| ⋮ | ⋮ |

FIG. 21B

POWER CONSUMPTION SENT FROM UNITS

705

| | |
|---|---|
| 1 | UNIT ID |
| 2 | POWER CONSUMPTION OF UNIT: TT (W) |
| 3 | ELECTRIC POWER LINE DATA (5 V, 24 V, etc) |

FIG. 23A PAPER FEED REQUEST INFORMATION SENT TO UNITS (COMMON PART)

711

| | |
|---|---|
| 1 | COMMAND ID (PAPER FEED REQUEST) |
| 2 | PAGE ID |
| 3 | COLOR MODE |
| 4 | PAPER SIZE |
| 5 | MATERIAL INFORMATION |
| 6 | PRINTED SIDE INFORMATION (FIRST/SECOND) |

FIG. 23B PAPER FEED REQUEST INFORMATION SENT TO PLATFORM CONTROL UNIT 65 (FIXED PART)

712

| | |
|---|---|
| 1 | FEEDER STATION INFORMATION |
| 2 | PAPER OUTPUT DIRECTION (REVERSE/STRAIGHT/DUPLEX) |

FIG. 23C PAPER FEED REQUEST ACK INFORMATION SENT FROM PLATFORM CONTROL UNIT 65

713

| | |
|---|---|
| 1 | COMMAND ID (PAPER FEED REQUEST ACK) |
| 2 | PAGE ID |
| 3 | FEEDER STATION INFORMATION |
| 4 | PAPER FEED STATUS (OK OR NOT OK) |
| 5 | "NOT OK" CAUSE |

FIG. 23D IMAGE FORMING REQUEST SENT TO IMAGE FORMATION CONTROL UNIT 160

714

| | |
|---|---|
| 1 | COMMAND ID (IMAGE FORMING REQUEST) |
| 2 | PAGE ID |
| 3 | COLOR MODE |

FIG. 23E IMAGE FORMATION START MESSAGE SENT FROM IMAGE FORMATION CONTROL UNIT 160

715

| | |
|---|---|
| 1 | COMMAND ID (ACKNOWLEDGMENT OF IMAGE FORMATION) |
| 2 | PAGE ID |

FIG. 23F IMAGE FORMATION AND TRANSPORT TERMINATION MESSAGE SENT FROM PLATFORM CONTROL UNIT 65

716

| | |
|---|---|
| 1 | COMMAND ID (PAGE END ACKNOWLEDGMENT) |
| 2 | TERMINATION STATUS (OK OR NOT OK) |
| 3 | "NOT OK" CAUSE |

IMAGE FORMING APPARATUS INCLUDING AN INTERCHANGEABLE ENGINE AND AN INTERCHANGEABLE PAPER FEEDING AND OUTPUTTING SYSTEM

BACKGROUND OF THE INVENTION

1. Field of the Invention

The present invention relates to an image forming apparatus including an interchangeable engine as well as an interchangeable paper feeding and outputting system.

2. Description of the Related Art

Some image forming apparatuses including copiers and printers for performing only black and white printing or both black and white printing and color printing are known.

Also, by connecting a different apparatus to such an image forming apparatus, some image forming systems can be provided that have capabilities that otherwise could not be realized by the image forming apparatus alone.

Japanese Patent Laid-Open No. 11-292335 describes a copier formed by connecting an image reader unit to an image forming apparatus and capable of copying the image of an original document read out by the image reader unit. In addition, an image forming apparatus including a plurality of interchangeably stacked paper feeder units, which also serve as a mounting base of the image forming apparatus, has been proposed so that various types of feeder units can be used. Furthermore, some image forming apparatuses are known that are capable of being connected to a post-print processing apparatus (an accessory) that sorts or staples printed recording sheets.

Additionally, a variety of image forming apparatuses that are capable of having an optional unit attached thereto have been developed. For example, for some image forming apparatuses, although the standard functionality of the image forming apparatus is minimized, a duplex transport unit for turning over a recording sheet after one-side printing can be optionally attached to the image forming apparatuses. As noted above, by designing some units in the image forming apparatus to be removable, the image forming apparatus meets a user's specific requirements regarding usage of the image forming apparatus.

In general, a user selects an image forming apparatus that provides the functionality desired by the user, performance (such as black and white printing/color printing and the number of output pages per minute), and ease of use (such as the dimensions and the position of outputting sheets) from among various product lines of the image forming apparatus. Furthermore, when the user desires functionality and performance that are not provided by the image forming apparatus (such as duplex printing, sorting, or stapling), the user selects a configuration by, as described above, assembling an optional accessory, an optional apparatus, or an optional unit to the image forming apparatus so that the user can obtain the desired functionality and performance. By cooperating with the connected accessory, apparatus, or unit, the image forming apparatus can provide a variety of operations, which is convenient for the user.

However, the configuration and available accessories of an existing image forming apparatus are designed so that most typical users can comfortably use the image forming apparatus, and therefore, the image forming apparatus cannot flexibly provide the functionality that individual users desire.

That is, the existing image forming apparatus has a configuration so as to perform an operation in cooperation with the accessories, various apparatus, or units. Thus, the existing image forming apparatus can provide operations according to an operating mode, functionality, and performance available only in such a configuration. For example, when a feeder unit or an accessory is connected to the image forming apparatus, the total operating performance of the image forming apparatus may be limited depending on the combination of the image forming apparatus and a feeder unit (or an accessory). In addition, depending on the configuration of an image forming unit, a feeder unit, and a paper transport unit in the image forming apparatus, the total operating performance of the image forming apparatus is determined. As a result, the image forming apparatus does not flexibly provide the functionality that individual user desire.

SUMMARY OF THE INVENTION

The present invention addresses the problems described above by providing an image forming apparatus that flexibly provides the functionality that individual users desire.

According to an aspect of the present invention, an image forming apparatus includes an interchangeable image forming subsystem having an image bearing member, an exposure unit, a charging unit, and a developing unit, an interchangeable sheet transport subsystem for transporting a sheet medium in the image forming apparatus, a mounting base for removably supporting the image forming subsystem and the sheet transport subsystem, and a control unit for controlling the operation of the image forming apparatus. The mounting base is capable of mounting one of a plurality of the image forming subsystems having different performances and one of a plurality of the sheet transport subsystem having different specifications thereon. The control unit controls the operation of the image forming apparatus in accordance with a combination of the mounted image forming subsystem and the sheet transport subsystem.

Further features and advantages of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate numerous exemplary embodiments of the invention, and, together with the description, serve to explain the principles of the invention.

FIGS. 20A-20C illustrate parameters of configuration communication when the power is turned on.

FIGS. 21A and 21B illustrate parameters of configuration communication when the power is turned on.

FIGS. 22A and 22B illustrate the command sequence of the configuration information in detail when the power is turned on.

FIGS. 23A-23F illustrate communication parameters used when the image forming operation is performed.

DESCRIPTION OF THE EMBODIMENTS

Exemplary embodiments of the present invention are described in detail with reference to the accompanying drawings. The following description of exemplary embodiments is merely illustrative in nature and is in no way intended to limit the invention, its application, or uses. All of the features and the combinations thereof described in the embodiments are not necessarily essential to the invention.

Hardware Configuration according to First Exemplary Embodiment

System Architecture

Figure 1:
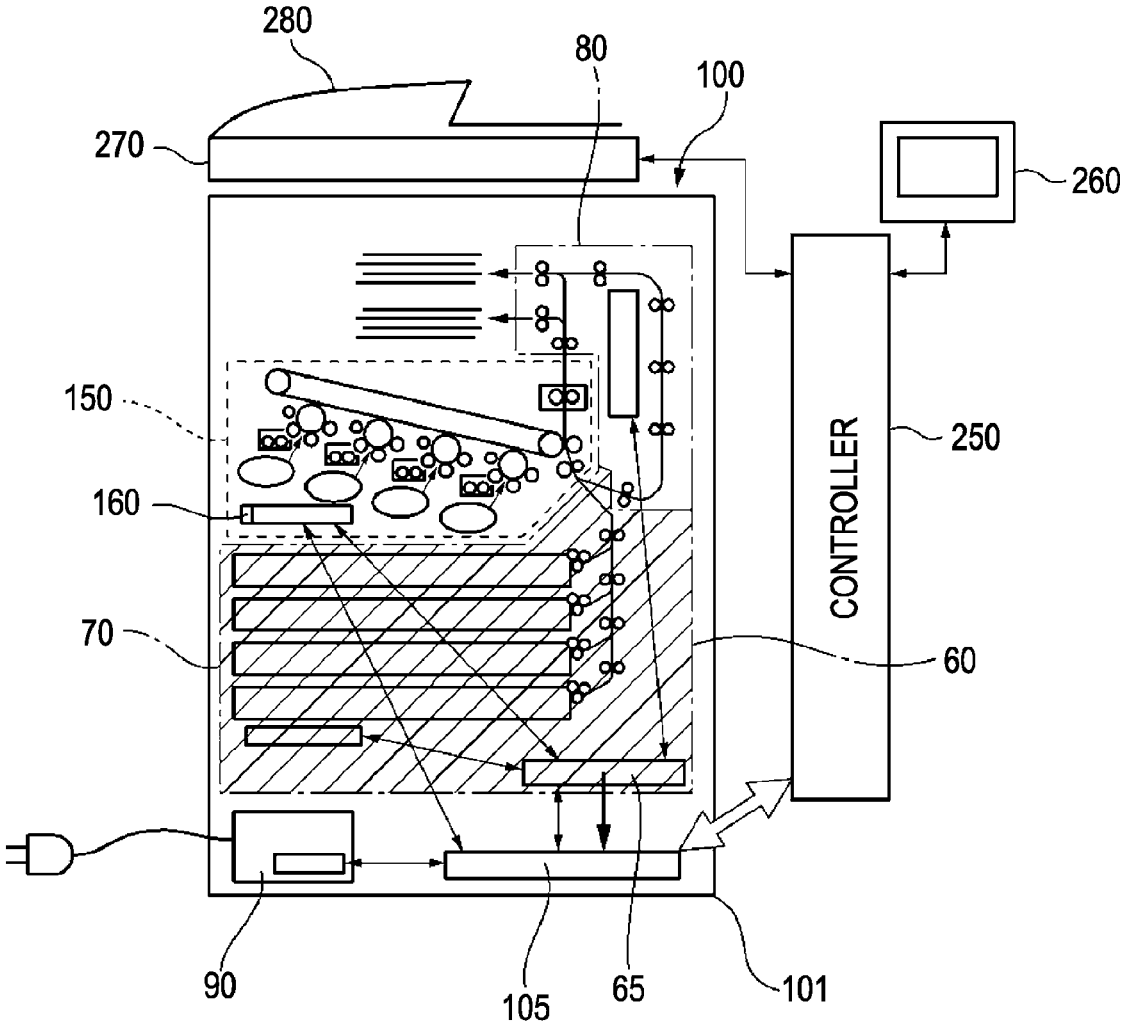
FIG. 1 is an illustration of an exemplary hardware configuration of an image forming apparatus according to a first exemplary embodiment of the present invention.

FIG. 1 is an illustration of an exemplary hardware configuration of an image forming apparatus according to a first exemplary embodiment of the present invention.

According to the first exemplary embodiment, the image forming apparatus is a multifunction printer (MFP) including an electrophotographic printer engine 100. The image forming apparatus receives data from a scanner, a facsimile, a copier, and a personal computer (PC) and serves as a printer that prints the received data. The printer engine 100 has color print capability using a photoconductor and intermediate transfer method.

The printer engine 100 is a main component of the image forming apparatus for printing. The printer engine 100 converts an original document image to image information and prints the image information. In the printer engine 100, a paper transport subsystem (hereinafter referred to as a "paper transport platform") 60 and an image forming subsystem 150 are mounted on an engine platform 101 serving as a mounting base. Additionally, on the paper transport platform 60, a feeder unit 70 and a transport unit 80 are mounted. A power supply unit 90 is mounted on the engine platform 101.

A document feeder unit 280 feeds a document set on the document feeder unit 280 to the readout position on an image reader unit 270. An image of the document fed to the readout position on an image reader unit 270 is converted to image information by the image reader unit 270. The image information is delivered to a controller 250. The controller 250 performs a desired process on the image information and delivers the processed image information to the printer engine 100. The information about the readout document image is printed by the printer engine 100 so that the copying function of the document image is realized.

An operation unit 260 is used when a user inputs a print mode, a print count, and print conditions or a service person performs a maintenance operation. When a print start key (not shown) of the operation unit 260 is depressed, the readout operation of a document image starts and a desired operation, such as a printing operation performed by the printer engine 100 or transmission of the document image, also starts.

Example of Replaceable Structure of Image Forming Subsystem

According to the present embodiment, by configuring an image forming subsystem primarily for forming an image to be interchangeable, the following advantages are provided to users and service persons. Hereinafter, as configurations of an interchangeable image forming subsystem, three types of printer engine 100 having different performances are described with reference to FIGS. 2 to 4.

Figure 2:
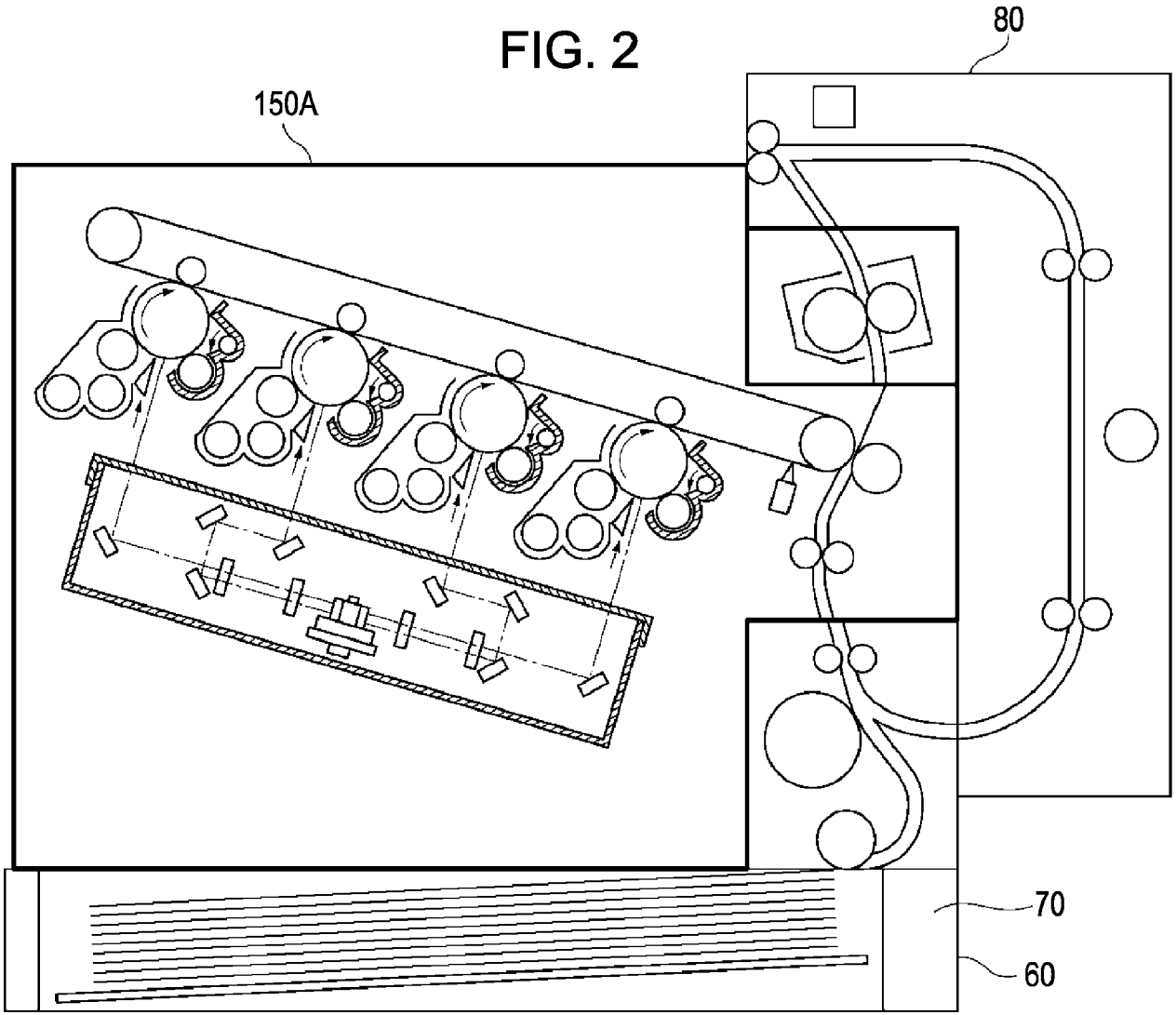
FIG. 2 is a cross-sectional view of a first example of the interchangeable configuration of an image forming subsystem.

FIG. 2 is a cross-sectional view of a first example of the interchangeable configuration of the image forming subsystem 150. In this example, the color printer engine 100 including the color image forming subsystem 150A as the image forming subsystem 150 is used. The color image forming subsystem 150A is based on a four-drum tandem method (hereinafter referred to as a 4D method) and is assembled into the engine platform 101. The color image forming subsystem 150A includes four photoconductive drums serving as image bearing members, an exposure unit, a charging unit, and a developing unit. In particular, the image forming subsystem 150A is suitable for high-productivity color image formation. The image forming subsystem 150A may be used for high-volume printing, such as in an office, or may be used for low-volume printing. Additionally, the color image forming subsystem 150A may be replaced with a variety of image forming subsystems 150, one of which has, for example, A4 20-ppm (pages per minute) or 70-ppm color printing capability as needed.

Figure 3:
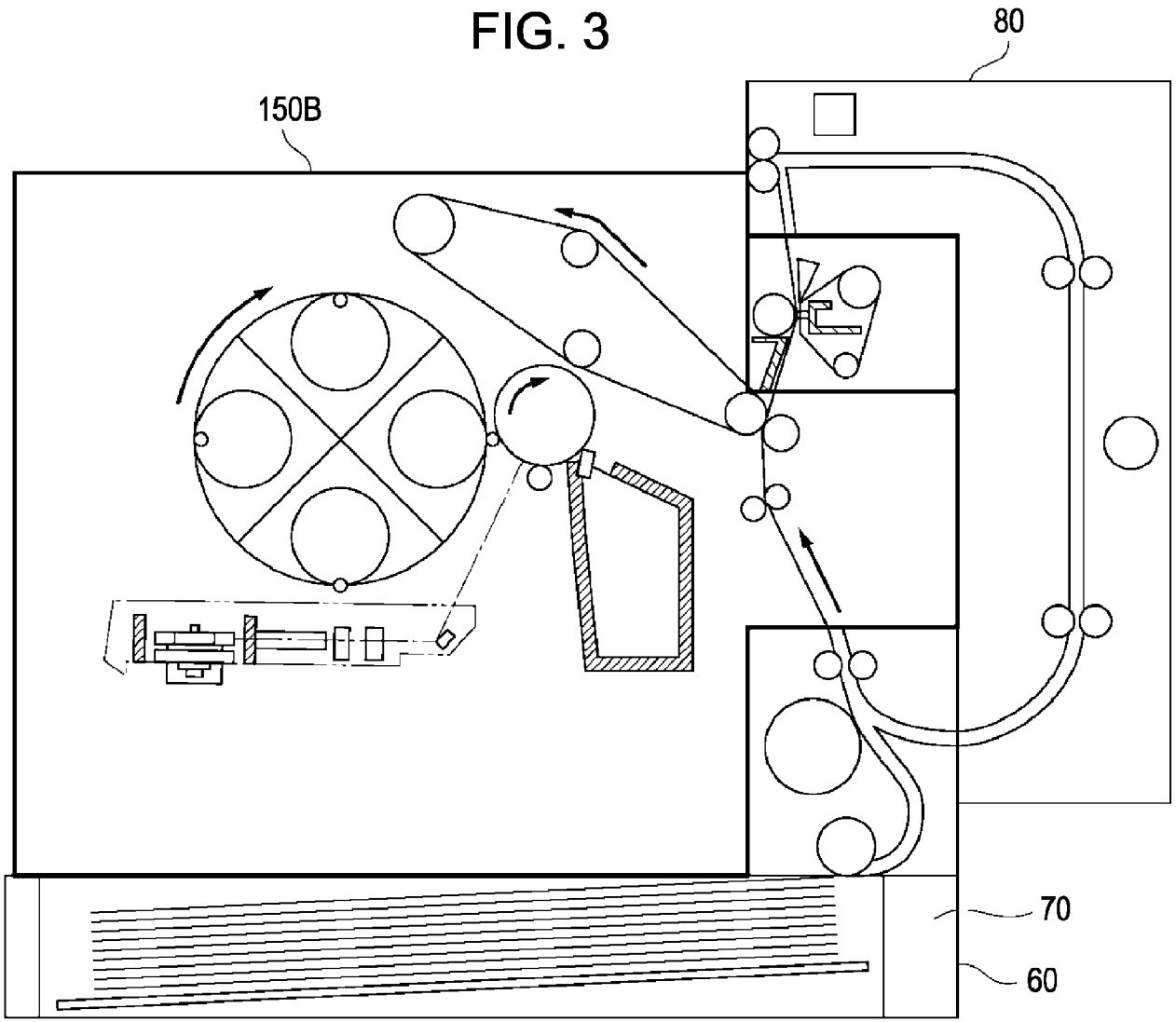
FIG. 3 is a cross-sectional view of a second example of the interchangeable configuration of an image forming subsystem.

FIG. 3 illustrates an example of the configuration of the color printer engine 100 in which a color image forming subsystem 150B of a one-drum method is assembled in the engine platform 101 as the image forming subsystem 150. The color image forming subsystem 150B includes one photoconductive drum serving as an image bearing member, an exposure unit, a charging unit, and a developing unit. In particular, the image forming subsystem 150B is suitable for high-quality color image formation, such as photo printing document or graphic design. The color image forming subsystem 150A may be replaced with a variety of the image forming subsystems 150, one of which has, for example, 400-dpi (dots per inch), 600-dpi, or 1200-dpi resolution printing capability or has the capability of using a variety of toner and transfer media as needed.

Figure 4:
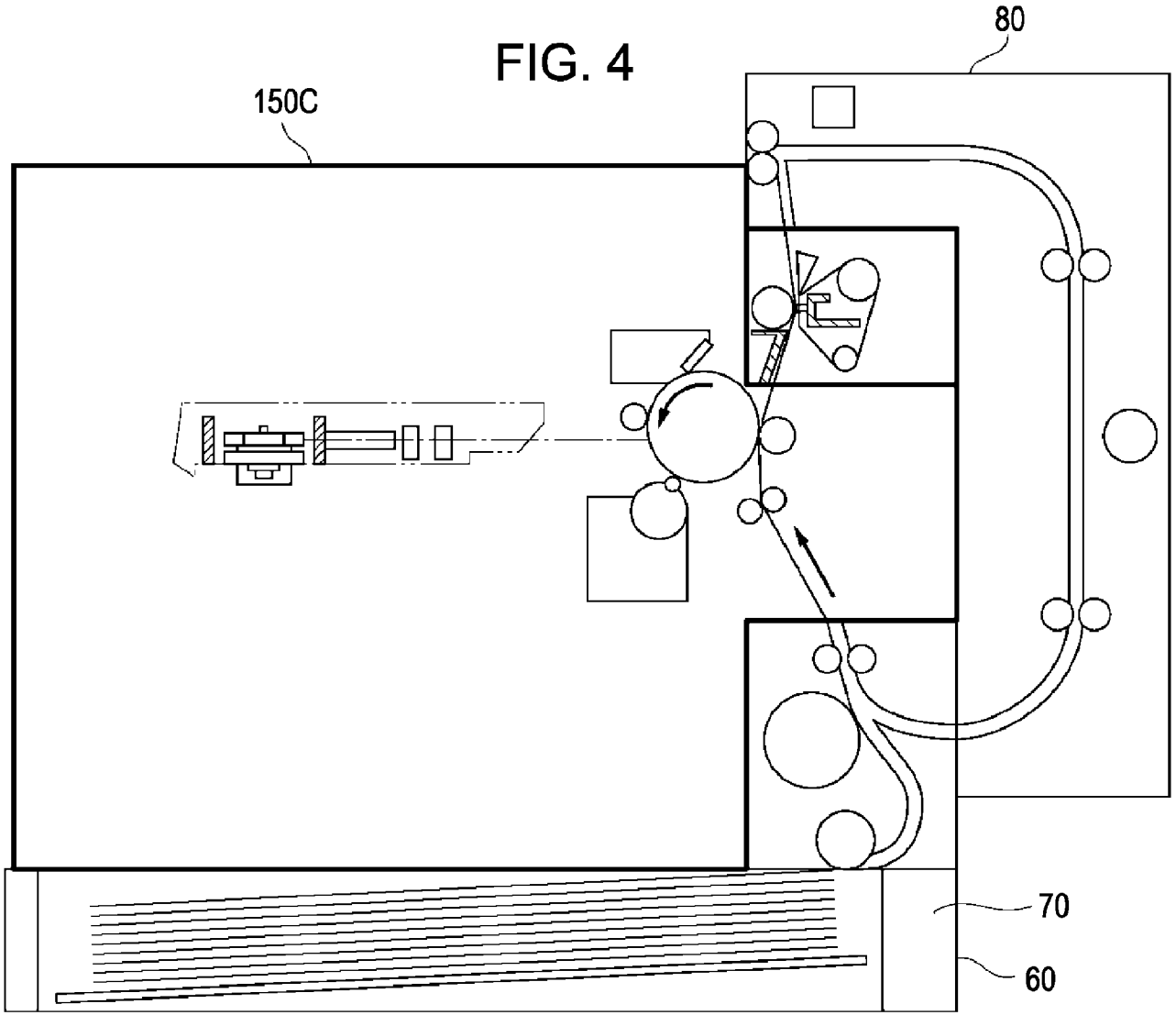
FIG. 4 is a cross-sectional view of a second example of the interchangeable configuration of an image forming subsystem.

FIG. 4 illustrates an example of the configuration of the black and white printer engine 100 in which a black and white image forming subsystem 150C of a one-drum method is assembled into the engine platform 101 as the image forming subsystem 150. The black and white image forming subsystem 150C includes one photoconductive drum serving as an image bearing member, an exposure unit, a charging unit, and a developing unit. In particular, the image forming subsystem 150C may be used for high-volume printing, such as in an office, or may be used for low-volume printing. Additionally, the image forming subsystem 150C may be replaced with a variety of image forming subsystems 150, one of which has, for example, A4 20-ppm (pages per minute) or 100-ppm black and white printing capability as needed.

Example of Replaceable Structure of Paper Transport Platform 60

Figure 5A:
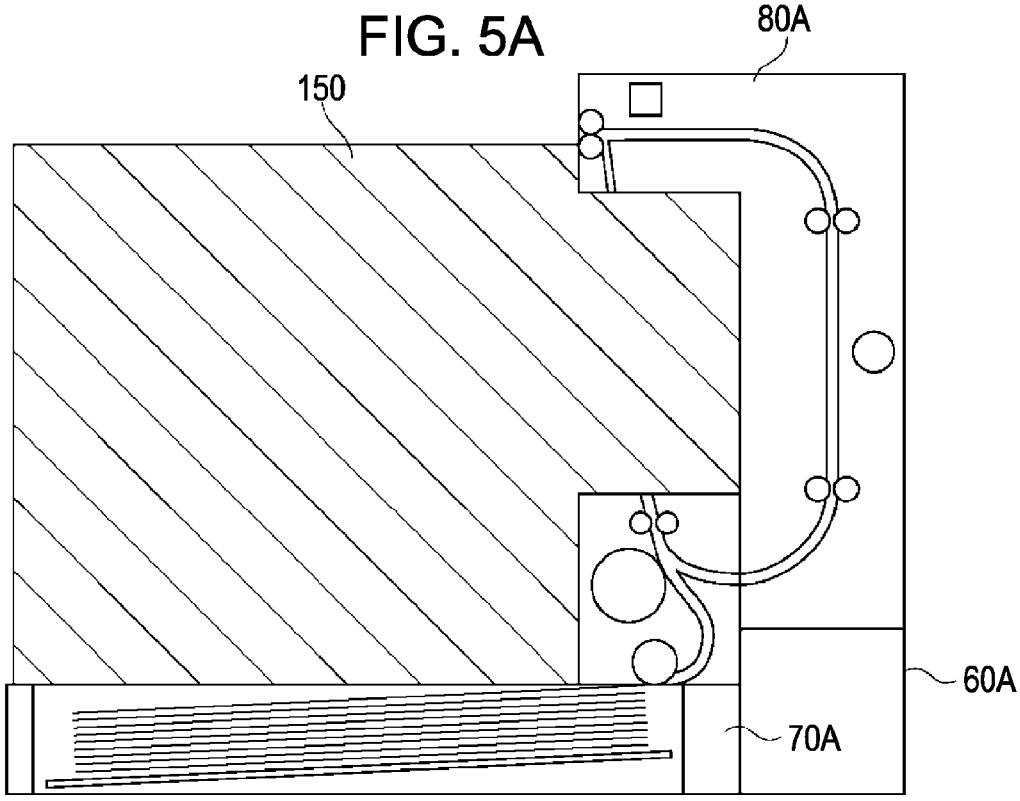
FIGS. 5A and 5B are cross-sectional views of examples of the interchangeable configuration of a paper transport platform.
Figure 5B:
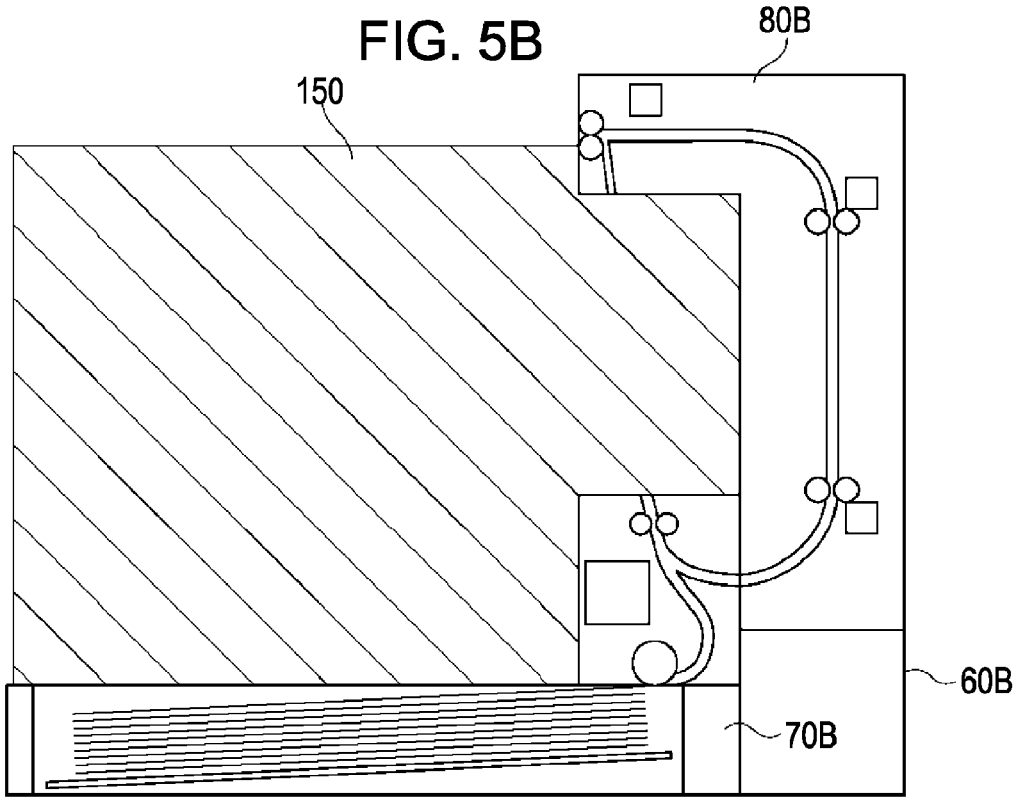

FIG. 5A is a cross-sectional view of the paper transport platform 60 into which a feeder unit 70A and a transport unit 80A are assembled. FIG. 5B is a cross-sectional view of the paper transport platform 60 into which a feeder unit 70B and a transport unit 80B are assembled. The paper transport platform 60 is mounted on the engine platform 101. In FIGS. 5A and 5B, the paper transport platform 60 including the feeder units 70A and 80A having different specifications and the paper transport platform 60 including the feeder units 70B and 80B having different specifications are illustrated. However, the combinations of the units are not limited thereto. For example, the combination of the feeder unit 70 and the transport unit 80 appropriate for the requirement and specification for the product may be selected and may be assembled into the paper transport platform 60. By identifying the assembled unit or communicating with the assembled unit, a platform control unit 65 collects control information associated with the assembled unit and exchanges that control information with a printer engine control unit 105. The platform control unit 65 then performs control of the paper transport platform 60 on the basis of the control specification determined by the printer engine control unit 105.

By configuring the paper transport platform 60, which is mounted on the engine platform 101 and primarily provides a paper transport function, so that the transport unit 80 and the feeder unit 70 are interchangeable, many configurations of the product can be provided.

The examples of the configuration of the printer engine 100 are described next with reference to FIGS. 5A and 5B as an interchangeable configuration of the paper transport platform 60. That is, two types of printer engine 100 in which the same image forming subsystem 150 is used and the transport units 80 and the feeder units 70 on the paper transport platform 60 mounted on the engine platform 101 are interchangeable are illustrated.

For example, as shown in FIG. 5A, the paper transport platform 60A of a slow speed type including a feeder unit 70A and a transport unit 80A is combined with the image forming subsystem 150. In contrast, as shown in FIG. 5B, the paper transport platform 60B of a high speed type including a feeder unit 70B and a transport unit 80B is combined with the image forming subsystem 150.

Thus, the printer engine 100 can be selectively configured by combining the feeder unit and the transport unit in the paper transport platform 60 with the image forming subsystem 150 having the desired image quality and specification.

Hardware Configuration of Feeder Unit and Transport Unit

The feeder unit 70 and the transport unit 80 are described next.

Figure 6A:
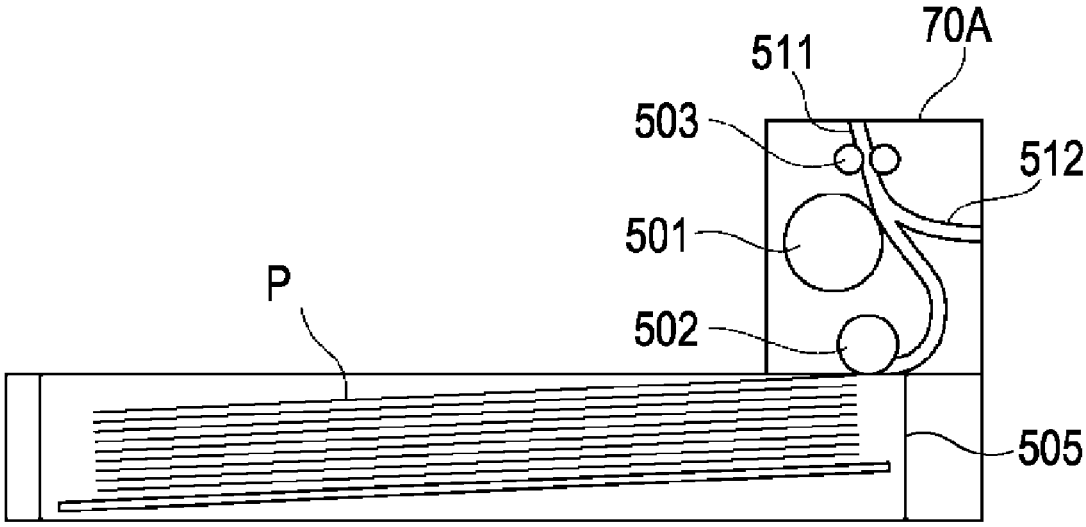
FIGS. 6A and 6B are cross-sectional views illustrating an exemplary configuration of a feeder unit.
Figure 6B:
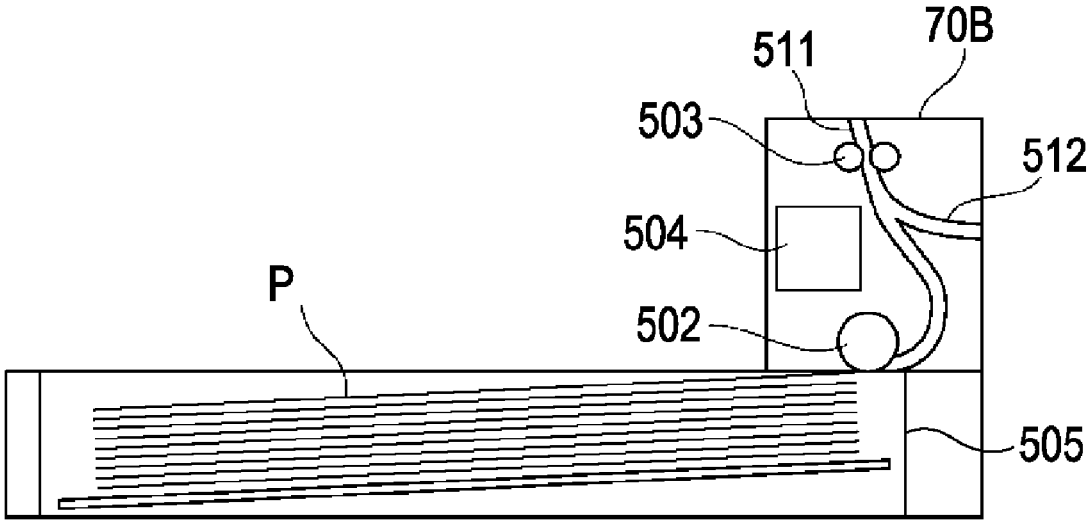

FIGS. 6A and 6B are cross-sectional views illustrating the configuration of the feeder unit 70. Feeder units having different types of performance are interchangeably connected to the paper transport platform 60. As the feeder units having different performances, the slow-speed feeder unit 70A and the high-speed feeder unit 70B are described next. As shown in FIG. 6A, the slow-speed feeder unit 70A includes a DC brushless motor 501, a pickup roller 502 rotatably driven by the DC brushless motor 501, a transport roller 503 rotatably driven by the DC brushless motor 501, a paper feed path 511, and a paper refeed path 512 in which a transfer medium P passes.

The feeder unit 70A is controlled by the platform control unit 65 or a feeder unit controller (not shown) in the feeder unit 70A. The DC brushless motor 501 rotates at a predetermined speed. In a paper feed operation, the pickup roller 502 is controlled by, for example, a solenoid (not shown) so as to be brought into contact with the transfer medium P or be separated from the transfer medium P at a predetermined timing. The transfer medium P is stored in a feeder cassette 505. The pickup roller 502 driven by the DC brushless motor 501 is brought into contact with the transfer medium P to pick up the transfer medium P. The transfer medium P is then fed into the paper feed path 511 and is transported by the transport roller 503 in the paper feed path 511 towards the image forming subsystem 150 at a predetermined speed. The transfer medium P re-fed from a transport unit, which is described below, passes through the paper refeed path 512 and is transported by the transport roller 503 to the image forming subsystem 150.

The high-speed feeder unit 70B shown in FIG. 6B includes a stepping motor 504 for driving the pickup roller 502 and the transport roller 503. The feeder unit 70B is controlled by the platform control unit 65 or a feeder unit controller (not shown) in the feeder unit 70B. The stepping motor 504 rotates at a predetermined variable speed. In a paper feed operation, the pickup roller 502 is controlled by, for example, a solenoid (not shown) so as to be brought into contact with the transfer medium P or be separated from the transfer medium P at a predetermined timing.

The transfer medium P is stored in a feeder cassette 505. The pickup roller 502 driven by the stepping motor 504 is brought into contact with the transfer medium P to pick up the transfer medium P. The transfer medium P is then fed into the paper feed path 511 and is transported by the transport roller 503 in the paper feed path 511 towards the image forming subsystem 150 at a predetermined speed. The transfer medium P re-fed from a transport unit, which is described below, passes through the paper refeed path 512 and is transported by the transport roller 503 towards the image forming subsystem 150. At that time, the transport speed of the transfer medium P is variably controlled in accordance with the variable rotational speed of the stepping motor 504 so that the transport speed of the transfer medium P and the spacing between the successively fed transfer media P can be controlled in a stepwise fashion in a wide range.

While the above-described description of the feeder unit 70 has been made with reference to a one-feeder station, the one-feeder station is not intended to be limited to such applications. The present embodiment is applicable to multiple stacked (joined or connected) feeder stations so that a plurality of types and sizes of the transfer medium P are available.

Figure 7A:
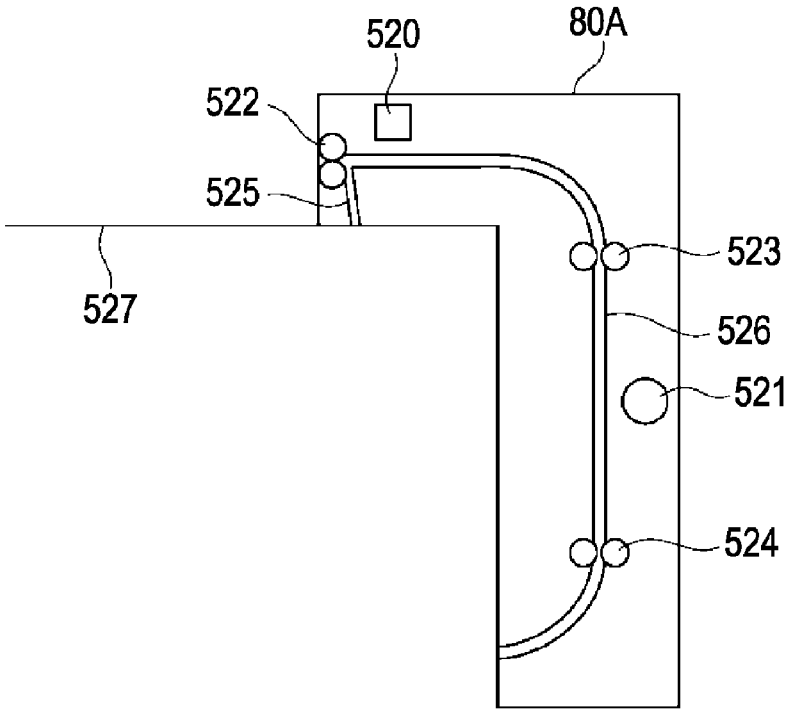
FIGS. 7A and 7B are cross-sectional views illustrating an exemplary configuration of a transport unit.
Figure 7B:
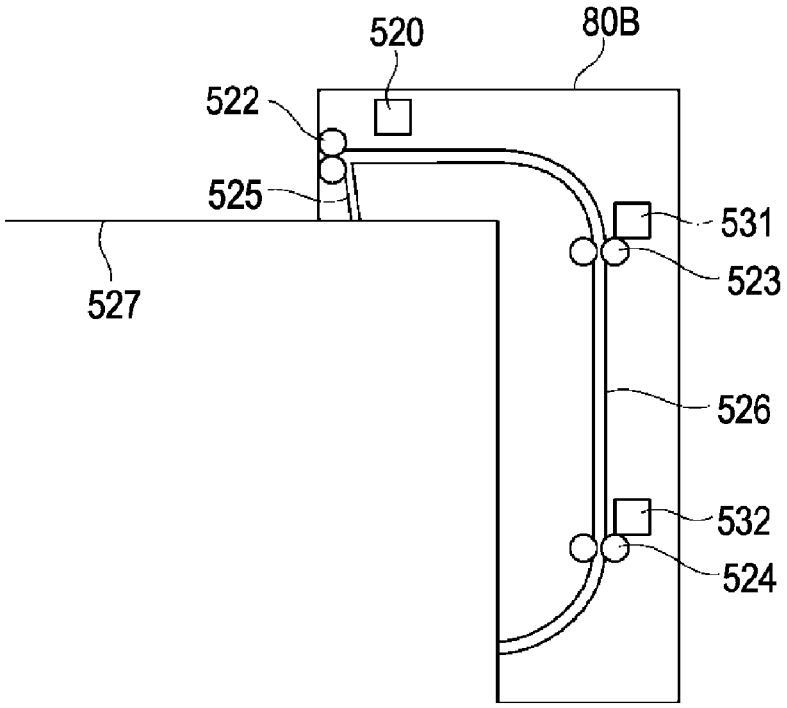

FIGS. 7A and 7B are cross-sectional views illustrating the configuration of the transport unit 80.

One of transport units having different performances is interchangeably connected to the paper transport platform 60. As the transport units having different performances, the slow-speed transport unit 80A and the high-speed transport unit 80B are described next.

The slow-speed transport unit 80A shown in FIG. 7A includes a stepping motor 520, a DC brushless motor 521, a paper output roller 522 rotatably driven by the stepping motor 520 in the clockwise and counterclockwise directions, transport rollers 523 and 524 driven by the DC brushless motor 521, a paper output path 525, and a transport path 526.

The transport unit 80 is controlled by the platform control unit 65 or a transport unit controller (not shown) in the transport unit. The stepping motor 520 is controlled so as to rotate in the clockwise direction and the counterclockwise direction in accordance with an operating mode. The DC brushless motor 521 rotates at a predetermined speed. In a transport operation, the transfer medium P transported from a fixing unit 180 of the image forming subsystem 150 is fed into the paper output path 525. To output the transfer medium P, the paper output roller 522 rotates in a direction so as to output the transfer medium P to an output tray 527. Thus, the transfer medium P is output to the output tray 527. When the transfer medium P is transported in a reverse direction for duplex printing, the paper output roller 522 rotates in a direction so as to output the transfer medium P. The stepping motor 520 stops and rotates in the reverse direction with the paper output roller 522 pinching the trailing edge of the transfer medium P. Thus, the paper output roller 522 stops and rotates in the reverse direction so that the transfer medium P is transported to the transport path 526. The transfer medium P is transported in the transport path 526 by the transport rollers 523 and 524 driven by the DC brushless motor 521, which is rotating at a predetermined speed. The transfer medium P is then fed to the paper refeed path 512 of the feeder unit 70.

The high-speed transport unit 80B shown in FIG. 7B includes stepping motors 531 and 532. The stepping motor 531 rotates the transport roller 523 whereas the stepping motor 532 rotates the transport roller 524. The transport unit 80B is controlled by the platform control unit 65 or a transport unit controller (not shown) in the transport unit 80B. The stepping motors 520, 531, and 532 rotate in predetermined directions at predetermined variable speeds.

In a transport operation, the transfer medium P transported from the fixing unit 180 of the image forming subsystem 150 is fed into the paper output path 525. To output the transfer medium P, the paper output roller 522 rotates in a direction so as to output the transfer medium P to an output tray 527. Thus, the transfer medium P is output to the output tray 527. When the transfer medium P is transported in a reverse direction for duplex printing, the paper output roller 522 rotates in a direction so as to output the transfer medium P. The stepping motor 520 stops and rotates in the reverse direction with the paper output roller 522 pinching the trailing edge of the transfer medium P. Thus, the paper output roller 522 stops and rotates in the reverse direction so that the transfer medium P is transported to the transport path 526.

The transfer medium P is transported in the transport path 526 by the transport roller 523, which is rotated by the stepping motor 531 at a variably controlled speed, and the transport roller 524, which is rotated by the stepping motor 532 at a variably controlled speed. The transfer medium P is then fed to the paper refeed path 512 of the feeder unit 70. At that time, the transport speed of the transfer medium P is variably controlled in accordance with the variable rotational speeds of the stepping motors 531 and 532 so that the transport speed of the transfer medium P and the spacing between the successively fed transfer media P can be controlled in a stepwise fashion in a wide range.

Method of Replacing Image Forming Subsystem and Unit

Figure 8:
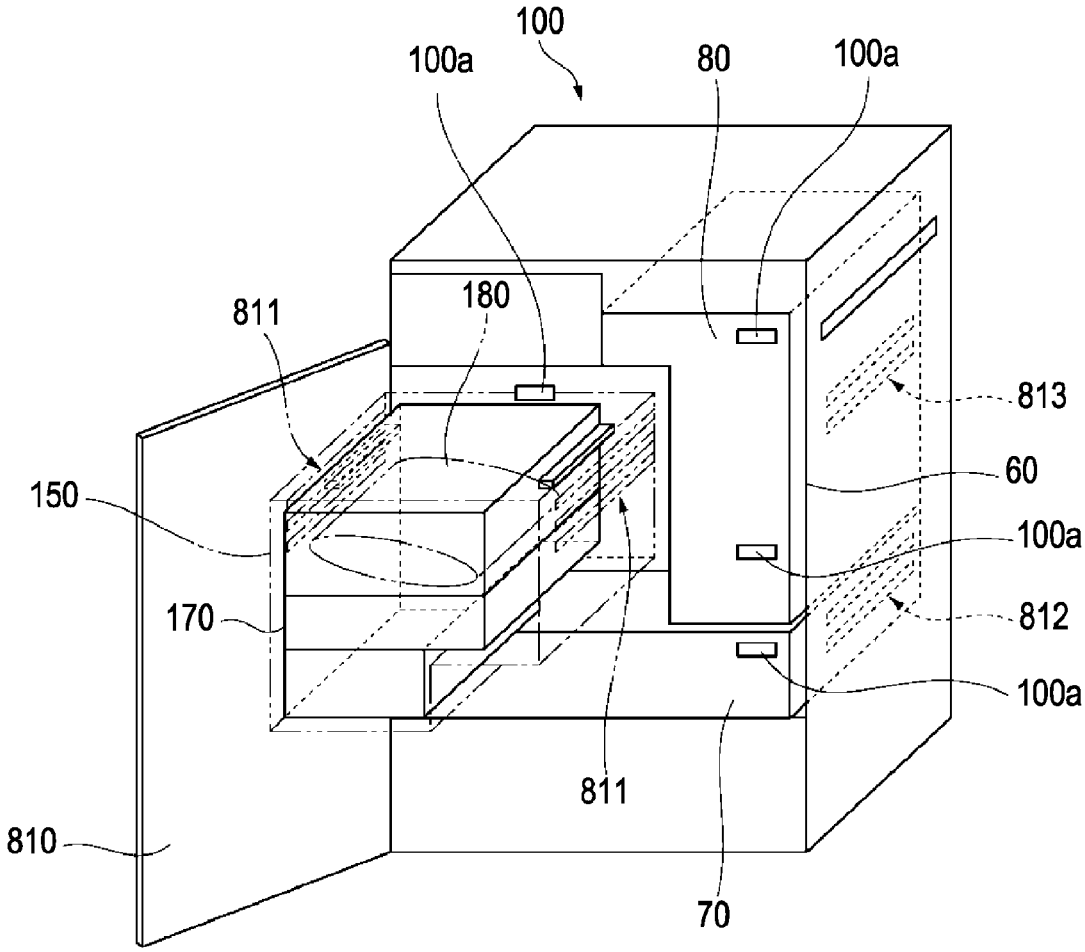
FIG. 8 is a perspective view of a printer engine when the image forming subsystem is pulled out from the paper transport platform.

FIG. 8 is a perspective view of the printer engine 100 when the image forming subsystem 150 is pulled out from the engine platform 101.

In the first embodiment, the image forming subsystem 150 is pulled out from the engine platform 101 with the front cover 810 of the printer engine 100 open. The image forming subsystem 150 is connected to the engine platform 101 and the paper transport platform 60 using left and right slide rails 811. The image forming subsystem 150 can be pulled out and removed from the engine platform 101 by operating a removal knob 100*a*. When the image forming subsystem 150 is removed from the engine platform 101, an image producing unit 170 and the fixing unit 180 mounted on the image forming subsystem 150 are also removed.

The feeder unit 70 and the transport unit 80 in the paper transport platform 60 are described next.

Like the image forming subsystem 150, the feeder unit 70 is connected to the paper transport platform 60 via left and right slide rails 812 and can be pulled out and removed. Like the feeder unit 70, the transport unit 80 is connected to the paper transport platform 60 via left and right slide rails 813 and is can be pulled out and removed.

When the weights of the image forming subsystem 150 and the other units are relatively small or strictly precise mounting positions are not required, the above-described slide rails may be inexpensive ones. In addition, when relatively high precision is required, a variety of linear sliding guides (guide rails) can be employed. Thus, the operability, precision, reliability, and durability can be increased.

To mount a relocatable (connectable and removable) component in an image forming apparatus, the maintainability should be taken into account as well as the position of the component. Additionally, when considering a market requirement for features and serviceability, some apparatuses allow a user to remove or relocate the component. In such a type of usage, in particular, the safety of the user when operating a heavy component should be taken into account. In addition, it is desirable that the apparatus has sufficient hardness and rigidity so that the apparatus is not damaged even when the user roughly operates the apparatus.

For example, the front cover 810 includes a locking mechanism. When a user can carry out a maintenance operation of the apparatus, the front cover 810 is unlocked so that the front cover 810 is openable. However, when the user cannot carry out the maintenance operation of the apparatus, the front cover 810 is locked so that the front cover 810 cannot be open. After a service person unlocks the locking mechanism, the image forming subsystem 150 can be pulled out from the apparatus. Accordingly, the user has little chance to unintentionally touch the internal component, and therefore, the safety can be maintained. In addition, since the service person pulls out the internal component after a predetermined procedure is carried out, the apparatus can be operated more safely.

Positioning Configuration of Image Forming Apparatus

Figure 9A:
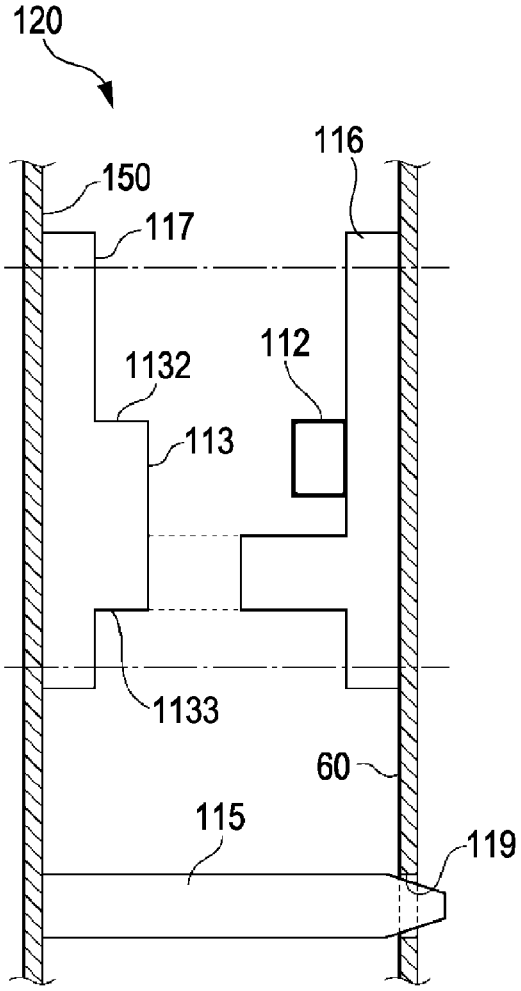
FIGS. 9A and 9B are partial magnified views of a positioning mechanism of the image forming subsystem.
Figure 9B:
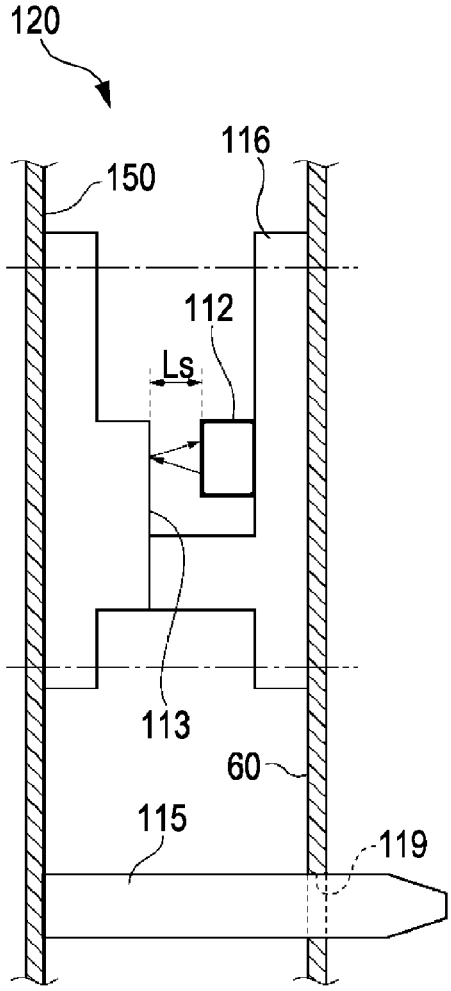

FIGS. 9A and 9B are partial magnified views of a positioning mechanism of the image forming subsystem 150. FIG. 9A illustrates the image forming subsystem 150 and the engine platform 101 (or the paper transport platform 60) before installation. FIG. 9B illustrates the image forming subsystem 150 and the engine platform 101 (or the paper transport platform 60) after the installation.

It is important to design a configuration that can provide a removal operation having a high operational performance as well as the required precision and cost for removal of the image forming subsystem 150 by the user. To achieve such a configuration, the configuration of a removal mechanism and a method and configuration of the positioning mechanism 120 are key factors.

An example of a configuration that satisfies the required positioning precision by using a positioning pin 115, a positioning hole 119, and a release knob 100*a* while improving the user operability is described next. It should be understood that a variety of embodiments in addition to the present exemplary embodiment can be provided within the spirit and scope of the present invention. In the present embodiment, a method of using a positioning pin is discussed.

To obtain a smooth positioning operation, an optimal design of the shapes of the positioning pin 115 and the positioning hole 119 is discussed in addition to the positional relationship between the axis of the positioning pin 115 and a hole (i.e., a fitting method). That is, the positioning pin 115 is used when the positioning precision is required. The shape of the positioning pin 115 is determined depending on the required precision, the improvement level of the reliability, and ease of user operation.

The precision of the shape of a used component and the mounting precision of the component are determined depending on the required positioning precision and the level of the precision of components that form the positioning pin 115 and the positioning hole 119. Additionally, the length of an interface between the positioning pin 115 formed on the image forming subsystem 150 (e.g., one of the image forming subsystem 150A-C) and the positioning hole 119 formed on the engine platform 101 or the paper transport platform 60 is determined depending on the level of the operability and workability.

The inner diameter and the position of the positioning hole 119 are determined so that the required positioning tolerance with respect to the image forming subsystem 150 is satisfied. If needed, the precision of the right angle between the positioning hole 119 and the positioning pin 115 may be increased. The reference plane of the shape of the positioning pin 115 inserted into the positioning hole 119 is determined so that the position of the hole relative to the surface of the pin is precisely determined. Thus, by optimally designing the fitness between the positioning pin 115 and the positioning hole 119, the precision of the relative position between the paper transport platform 60 and the image forming subsystem 150 can be set within the required precision range.

To increase the operability, it is desirable that the entrance of the fitness has a shape having a large chamfered edge so that the positioning pin 115 is smoothly inserted and removed. Accordingly, the diameter and the nose shape of the shaft of the positioning pin 115 are determined depending on the length of a tapered portion of the positioning pin 115 and the offset level of the center of the inserted positioning pin 115 from the center of the positioning hole 119.

The guide length of positioning can be determined depending on the operability and the improvement level of the reliability of the apparatus. As shown in FIGS. 9A and 9B, the nose of the positioning pin 115 is slightly tapered so as to be easily guided when inserted into the hole. In particular, since the image forming subsystem 150 includes a variety of components required for realizing an image forming function, the image forming subsystem 150 is anticipated to be heavy. For example, for the color image forming subsystems 150A and 150B that carry out color image formation, further careful consideration of the operability is desirable.

In contrast, for the image forming subsystem 150C that carries out a black and white image formation, for example, the weight of the high-speed black and white image forming subsystem 150C for providing high productivity is anticipated to be substantially the same as that of the color image forming subsystem 150A or 150B. Additionally, the weight of the middle-speed black and white image forming subsystem 150C is anticipated to be substantially the same as that of the color image forming subsystem 150A or 150B or lighter than that of the color image forming subsystem 150A or 150B.

Thus, it is desirable that a positioning mechanism provides ease of user operation in addition to the desired safety, durability, reliability, and high precision even when any one of a variety of the image forming subsystems 150 is connected.

In contrast, if the model of the image forming subsystem 150 is relatively light-weighted or the required positioning precision is not strict, the removable mechanism and a positioning mechanism 120 can be changed to a relatively low-cost structure. Thus, cost reduction can be achieved.

According to the present exemplary embodiment, as shown in FIG. 8, the engine platform 101 of the image forming apparatus includes a removable mechanism using slide mechanisms 811 to 813 so that the image forming subsystem 150 can be pulled out. In such a structure in which the image forming subsystem 150 is removable, the positioning between a toner image that is to be transferred to the transfer medium P and the transfer medium P is critical. Therefore, a position detecting unit 112 is provided to the engine platform 101 or the paper transport platform 60 in order to detect a position between the image forming subsystem 150 and the engine platform 101 or between the image forming subsystem 150 and the paper transport platform 60 when the image forming subsystem 150 is mounted in the printer engine 100.

For a position sensor used in the position detecting unit 112, a small and low-cost optical displacement sensor has been developed and can be used in this embodiment. One of the examples of the sensor is a micro-displacement sensor available from OMRON Corporation. It should be appreciated that a position sensor other than an optical position sensor can be employed. The micro-displacement sensor available from OMRON Corporation (Z4DB02) has the following specification: the detectable distance is 9.5 mm±3 mm and the detecting resolution is ±50 μm. In the image forming subsystem 150 having a 400-dpi resolution, the size of one dot (pixel) is 25.4 mm/400 dots=63.5 μm. Therefore, the micro-displacement sensor can detect the displacement less than one-dot size (one-pixel size). In the image forming subsystem 150 having a 600-dpi resolution, the size of one dot (pixel) is 25.4 mm/600 dots=42.3 μm. Therefore, the detecting resolution corresponds to 1.18 dots. In the image forming subsystem 150 having a 1200-dpi resolution, the size of one dot (pixel) is 25.4 mm/1200 dots=21.2 μm. Therefore, the detecting resolution corresponds to 2.36 dots.

However, the detection of the relative position between the image forming subsystem 150 and the engine platform 101 or between the image forming subsystem 150 and the paper transport platform 60 is related to the detection of the relative position between an image to be printed and the transfer medium (transfer sheet) P. Accordingly, the resolution of about 50 μm is sufficient. For example, when a margin is 2.5 mm, a resolution of ±50 μm of the micro-displacement sensor in the position detecting unit 112 corresponds to 1/50 of the margin. Accordingly, this resolution is sufficient for a typical printing operation. If more precise position detecting resolution is required, the position detecting resolution can be increased from ±50 μm to ±10 μm by using, for example, the micro-displacement sensor Z4DB01 available from OMRON Corporation. Thus, the resolution of the position detecting unit 112 can be increased to five times higher than that of the micro-displacement sensor Z4DB02.

When a micro-displacement sensor is used in the position detecting unit 112, the detection result from the micro-displacement sensor is output in the form of an analog signal so that the output voltage from the micro-displacement sensor linearly decreases as the distance between the detection object and the micro-displacement sensor increases. Such position information from the micro-displacement sensor in the position detecting unit 112 is used to control the proper image forming position at which an image is printed on the transfer medium P.

By operating the release knob 100*a*, the image forming subsystem 150 is horizontally translated so as to be inserted into the engine platform 101. When the image forming subsystem 150 is contained in the engine platform 101, a subsystem reference surface 113 provided to a stopper 117, which serves as a reference position of the image forming subsystem 150, is brought into contact with a stopper 116 provided to the engine platform 101 or the paper transport platform 60 disposed at a position facing the subsystem reference surface 113. Thus, the positions of the image forming subsystem 150 in the axis direction of the positioning pin 115 are determined.

The position detecting unit 112 is disposed on the stopper 116. The positioning pin 115 on the image forming subsystem 150 is inserted into the positioning hole 119 of the printer engine, and therefore, the image forming subsystem 150 is contained in the engine platform 101 while maintaining the desired positioning precision. At that time, to detect a physical position of the paper transport platform 60 relative to the image forming subsystem 150, a position detecting sensor light beam is emitted from the position detecting unit 112 to the subsystem reference surface 113. The position detecting unit 112 then receives a reflected light beam off the subsystem reference surface 113 so as to detect a position (distance) Ls of the image forming subsystem 150. The position information (i.e., the distance Ls) detected by the position detecting unit 112 is delivered to the platform control unit 65 of the paper transport platform 60. Subsequently, position control information is sent from the platform control unit 65 to an image formation control unit 160 so that the image forming position is set to an optimal position on the basis of the detected position information.

Alternatively, a reference surface may be provided to the engine platform 101 or the paper transport platform 60 and the position detecting unit 112 may be disposed on the image forming subsystem 150 so that the position information may be sent to the image formation control unit 160. In addition, while the above-described description has been made with reference to the reference surface 113 as the reference surface of the stopper of the image forming subsystem 150, a different method and a different location may be added to the subsystem reference surface 113 or may be replaced with the subsystem reference surface 113. For example, the number of micro-displacement sensors in the position detecting unit 112 may be increased or the micro-displacement sensors may be relocated so that reference surfaces 1132 and 1133 are detected as the different reference surfaces of the stopper 117. Additionally, for example, the positional offsets of the reference surfaces 113, 1132, and 1133 in three directions may be detected, and therefore, three-dimensional positional offsets of the image forming subsystem 150 are more precisely detected and may be used for the correction control of the image position.

In addition, the positioning mechanism 120 may be advantageously located in the vicinity of a mechanism for transferring a toner image onto the transfer medium P. The positions of the transfer roller and the incoming transfer medium P can be more precisely controlled.

Details of Image Forming Subsystem 150

(A) Hardware Configuration of Image Forming Subsystem for 4D Full-Color Printer

The image forming subsystem 150 mounted on the engine platform 101 is described next.

Figure 10:
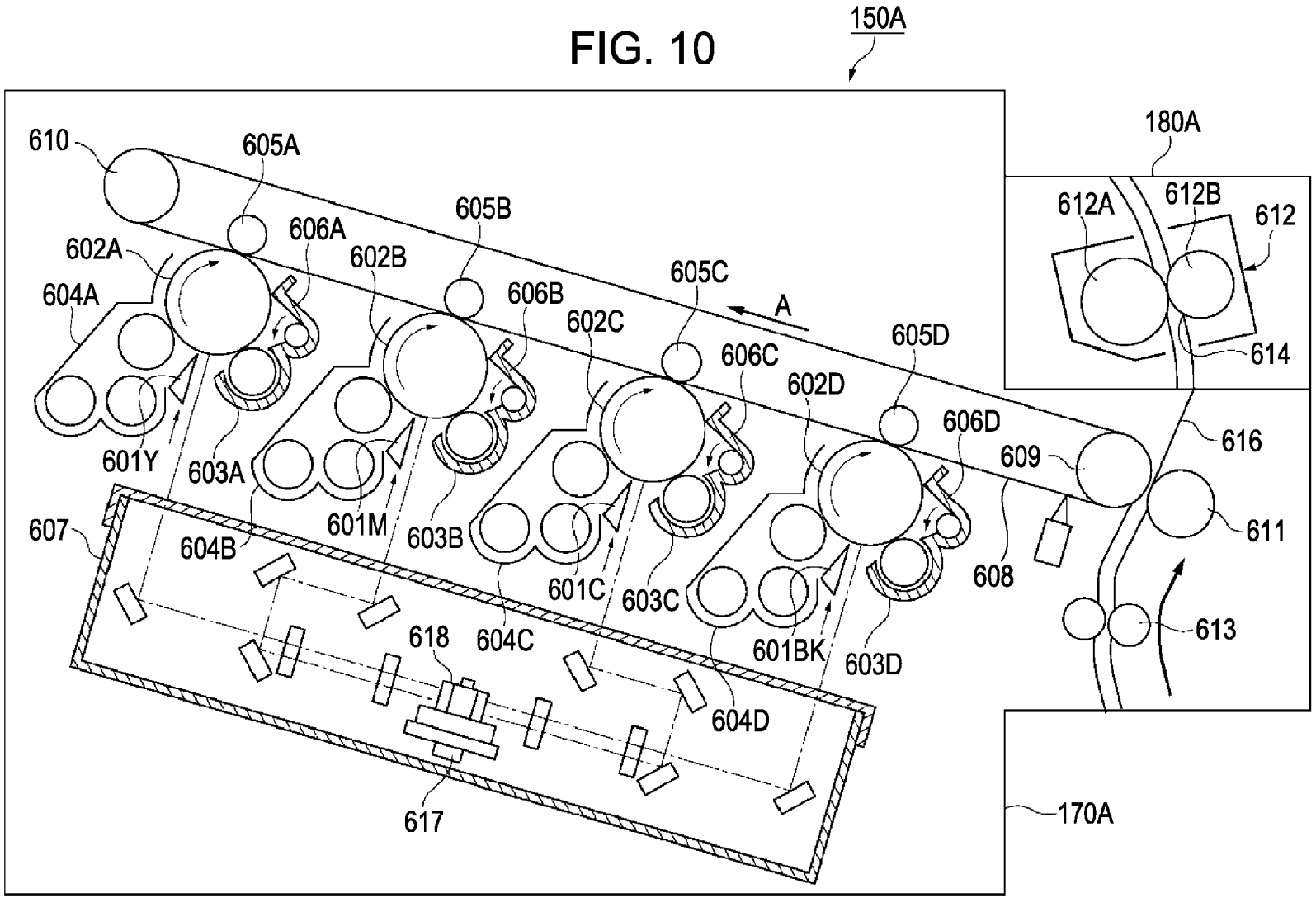
FIG. 10 is a cross-sectional view of an image forming subsystem for a 4D full-color printer.

FIG. 10 is a cross-sectional view of the detailed structure of the image forming subsystem 150A for a 4D full-color printer.

As shown in FIG. 10, the color image forming subsystem 150A includes an image producing unit 170A and a fixing unit 180A. These units can be replaced with different units having the same functionality. In addition, these units can be physically separated.

First, the image producing unit 170A is described.

The image producing unit 170A includes four image forming units, namely, an image forming unit 601Y for forming an image of a yellow color, an image forming unit 601M for forming an image of a magenta color, an image forming unit 601C for forming an image of a cyan color, and an image forming unit 601BK for forming an image of a black color. These four image forming units 601Y, 601M, 601C, and 601BK are arranged in a line with a predetermined spacing therebetween.

The image forming units 601Y, 601M, 601C, and 601BK include drum-shaped electrophotographic photoreceptors (hereinafter referred to as "photoconductive drums") 602A, 602B, 602C, and 602D as image bearing members, respectively. Around the photoconductive drum 602A, a primary charger 603A, a developing unit 604A, a transfer roller 605A serving as a transfer unit, and a drum cleaner 606A are disposed. Similarly, around the photoconductive drum 602B, a primary charger 603B, a developing unit 604B, a transfer roller 605B serving as a transfer unit, and a drum cleaner 606B are disposed. Around the photoconductive drum 602C, a primary charger 603C, a developing unit 604C, a transfer roller 605C serving as a transfer unit, and a drum cleaner 606C are disposed. Around the photoconductive drum 602D, a primary charger 603D, a developing unit 604D, a transfer roller 605D serving as a transfer unit, and a drum cleaner 606D are disposed. Under positions between the primary charger 603A and the developing unit 604A, between the primary charger 603B and the developing unit 604B, between the primary charger 603C and the developing unit 604C, and between the primary charger 603D and the developing unit 604D, a laser exposure unit 607 is disposed.

The developing units 604A, 604B, 604C, and 604D contain yellow toner, cyan toner, magenta toner, and black toner, respectively. Each of the photoconductive drums 602A, 602B, 602C, and 602D includes a photoconductive layer on an aluminum drum base composed of a negatively-charged OPC (opto-photoconductor) and is driven by a drive unit (not shown) to rotate in a clockwise direction shown in FIG. 11 at a predetermined process speed.

The primary chargers 603A, 603B, 603C, and 603D serving as a primary charging unit uniformly charge the surfaces of the photoconductive drums 602A, 602B, 602C, and 602D, respectively, at a predetermined negative potential by using a charge bias applied from a charge bias power supply (not shown). The developing units 604A, 604B, 604C, and 604D contain toner of the above-described colors and deposit the toner onto latent images formed on the photoconductive drums 602A, 602B, 602C, and 602D, respectively, so as to develop the latent images into visible toner images.

The transfer rollers 605A, 605B, 605C, and 605D serving as a primary transferring unit are disposed in primary transfer units 605A to 605D so as to be capable of being in contact with the photoconductive drums 602A, 602B, 602C, and 602D with an intermediate transfer belt 608 therebetween, respectively. The drum cleaners 606A, 606B, 606C, and 606D include cleaning blades for removing residual toner remaining on the photoconductive drums 602A, 602B, 602C, and 602D after primary transfer, respectively.

The intermediate transfer belt 608 is disposed above the photoconductive drums 602A, 602B, 602C, and 602D. The intermediate transfer belt 608 is stretched between a secondary transfer counter roller 609 and a tensioning roller 610. The secondary transfer counter roller 609 is disposed so as to be in contact with a secondary transfer roller 611 via the intermediate transfer belt 608. The intermediate transfer belt 608 is formed from a dielectric resin, such as a polycarbonate resin, a polyethylene terephthalate resin film, or polyvinylidene fluoride resin film.

Additionally, the intermediate transfer belt 608 has a primary transfer surface, which faces the photoconductive drums 602A, 602B, 602C, and 602D. The intermediate transfer belt 608 is disposed so that one end of the primary transfer surface adjacent to the secondary transfer roller 611 is tilted downward with respect to the other end. The laser exposure unit 607 includes a laser emitting unit (not shown) for emitting laser beams in response to given time-series electrical digital pixel signals, a polygon mirror 618, a scanner motor 617, and a reflecting mirror. The laser exposure unit 607 carries out exposure operations on the photoconductive drums 602A, 602B, 602C, and 602D so as to form electrostatic latent images of individual colors according to the image information on the surfaces of the photoconductive drums 602A, 602B, 602C, and 602D charged by the primary chargers 603A, 603B, 603C, and 603D, respectively. At the same time, a beam detection signal (BD) generating circuit (not shown) provided to the laser exposure unit 607 detects the laser beam deflected by the polygon mirror 618 in the main scanning direction. Furthermore, the laser exposure unit 607 includes an image-producing-unit controller (not shown) for controlling the operations of these components. Thus, the image-producing-unit controller controls the process speed of the image producing unit and the hue and density of an image.

The fixing unit 180A is described next.

The fixing unit 180A is disposed downstream of a secondary transfer unit 616 of the image producing unit 170A in the transport direction of the transfer medium P. The fixing unit 180A includes a fixing device 612 having a fuser roller 612A and a pressure roller 612B. The fuser roller 612A incorporates a heat source, such as a halogen heater. The fixing device 612 is disposed so as to form a vertical paper path structure. Additionally, the fuser roller 612A and the pressure roller 612B are rotatably driven by a drive unit (not shown) and the electrical power of the heat source in the fuser roller 612A is controlled so that the temperature of the surface of the fuser roller 612A is controlled. Furthermore, a fixing unit controller (not shown) for controlling these components is provided to the fixing unit 180A so that the rotational speed of the rollers, the temperature of the fuser roller 612A, and the process for abnormal conditions are controlled.

In addition, the image forming subsystem 150A for a 4D full-color printer includes the image formation control unit 160 that communicates with the image-producing-unit controller and the fixing unit controller. Thus, the image formation control unit 160 retrieves unit information from these control units and sends unit control information to these control units. Furthermore, the image formation control unit 160 exchanges various image signals with the controller 250 and exchanges control information with the printer engine control unit 105 and the platform control unit 65.

While the description above has been made with reference to the image producing unit and the fixing unit both of which include the control units, the image producing unit and fixing unit can operate without the control units. In such a case, an image forming control unit (not shown) controls the components in the image producing unit and the fixing unit.

(B) Hardware configuration of Image Forming Subsystem for 1D Full-Color Printer

Figure 11:
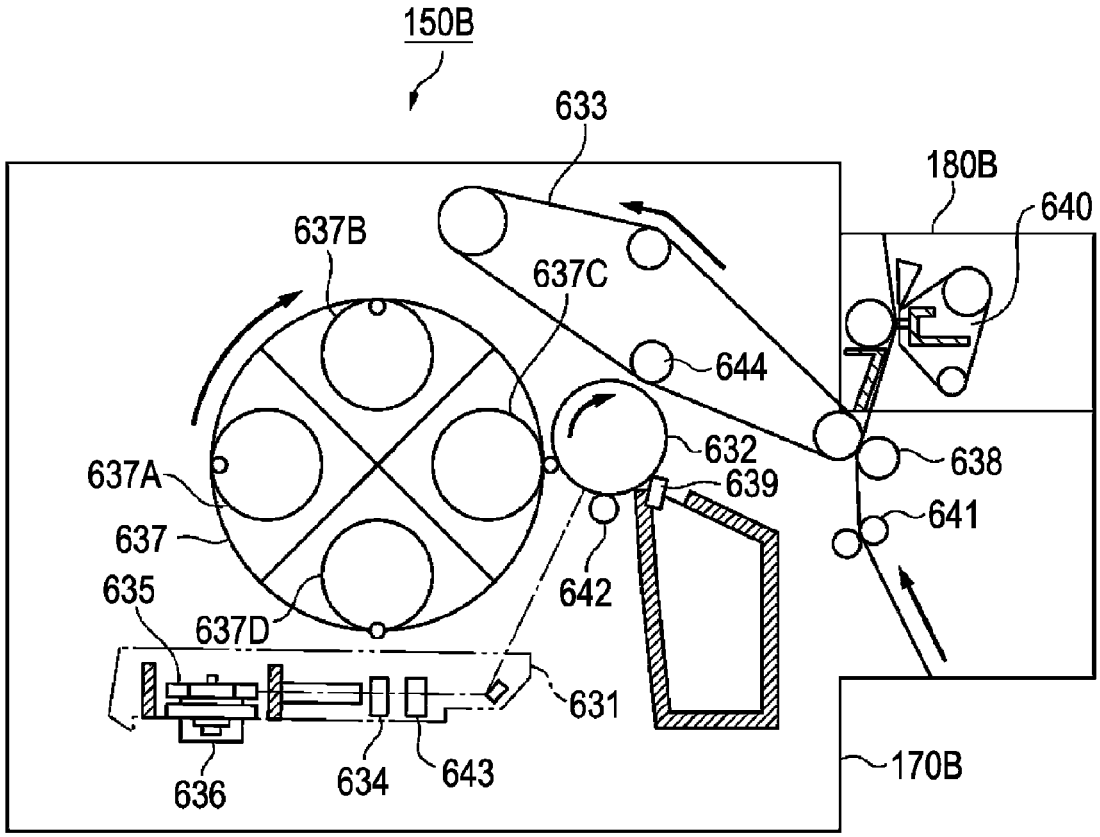
FIG. 11 is a cross-sectional view of an image forming subsystem for a 1D full-color printer.

FIG. 11 is a cross-sectional view of the detailed structure of the image forming subsystem 150B for a 1D full-color printer.

The color image forming subsystem 150B includes an image producing unit 170B and a fixing unit 180B. Like the 4D color image forming subsystem 150A having a vertical paper path structure, these units can be replaced with different units having the same functionality. In addition, these units can be physically separated.

First, the image producing unit 170B is described in detail.

The image producing unit 170B includes a scanner unit 631, a photoconductive drum 632, an intermediate transfer belt 633, a developing rotary 637, a primary transfer roller 644, a secondary transfer roller 638, and a cleaning blade 639. The scanner unit 631 incorporates a laser unit 634, a polyhedral mirror (polygon mirror) 635, a scanner motor 636, and a beam detection signal (BD signal) generating circuit 643. The developing rotary 637 includes developer units 637A-637D for individual colors.

The structure of each component of the image producing unit 170B is described next.

The photoconductive drum 632 of the image producing unit 170B includes a photoconductive layer on an aluminum drum base composed of an OPC (opto-photoconductor) and is driven by a drive unit (not shown) to rotate in a clockwise direction shown in FIG. 11 at a predetermined process speed. A primary charger 642 serving as a primary charging unit uniformly charges the surface of the photoconductive drum 632 at a predetermined negative potential based on a charge bias applied by a charge bias power supply (not shown).

In the scanner unit 631, the laser unit (hereinafter simply referred to as a "laser") 634 emits laser beams modulated on the basis of time-series electrical digital pixel signals of given image information. The polyhedral mirror (polygon mirror) 635 is a rotating polyhedral mirror that deflects the laser beam emitted from the laser 634 so as to scan the surface of the photoconductive drum 632 and form an electrostatic latent image on the photoconductive drum 632. The scanner motor 636 rotates the polygon mirror 635. The beam detection signal (BD signal) generating circuit 643 detects the laser beam deflected by the polygon mirror 635 in the main scanning direction.

The developing rotary 637 develops the electrostatic latent image formed on the photoconductive drum 632 by the developer units 637A, 637B, 637C, and 637D corresponding to yellow (Y), magenta (M), cyan (C), and black (BK), respectively. Like the above-described 4D color producing unit having the vertical paper path structure, the photoconductive drum 632 applies a primary transfer bias to the primary transfer roller 644 and primary-transfers a developer material developed on the photoconductive drum 632 by the developing rotary 637 to the intermediate transfer belt 633. The secondary transfer roller 638 is in contact with the intermediate transfer belt 633 and secondary-transfers the developer material on the intermediate transfer belt 633 onto the transfer medium P.

The cleaning blade 639 is in contact with the photoconductive drum 632 at all times so as to strip off the residual toner on the surface of the photoconductive drum 632. Thus, the photoconductive drum 632 is cleaned. Furthermore, like the above-described 4D color producing unit having the vertical paper path structure, an image-producing-unit controller (not shown) controls the operation of the components in the image producing unit. Thus, the image-producing-unit controller controls the process speed of the image producing unit and the hue and density of an image.

The fixing unit 180B is described next.

The fixing unit 180B is disposed downstream of the secondary transfer roller 638 of the image producing unit 170B in the transport direction of the transfer medium P. Like the above-described 4D color producing unit having the vertical paper path structure, a fixing device 640 fixes a toner image transferred onto the transfer medium P by heating and pressing the toner image. Rollers of the fixing device 640 are rotatably driven by a drive unit (not shown) and the electrical power of a halogen heater in the fixing device 640 is controlled so that the temperature of the surface of a fuser roller is controlled. Furthermore, a fixing unit controller (not shown) for controlling these components is provided to the fixing unit 180B so that the rotational speeds of the rollers, the temperature of the fuser roller, and the process for abnormal conditions are controlled.

Additionally, the image forming subsystem 150B for a 1D full-color printer includes the image formation control unit 160 that communicates with the image-producing-unit controller and the fixing unit controller. Thus, the image formation control unit 160 retrieves unit information from these controllers and sends unit control information to these controllers. Furthermore, the image formation control unit 160 exchanges various image signals with the controller 250 and exchanges control information with the printer engine control unit 105 and the platform control unit 65.

While the above-described description has been made with reference to the image producing unit and the fixing unit both of which include the control units, the image producing unit and fixing unit can operate without the control units. In such a case, an image forming control unit (not shown) controls the components in the image producing unit and the fixing unit.

Figure 12:
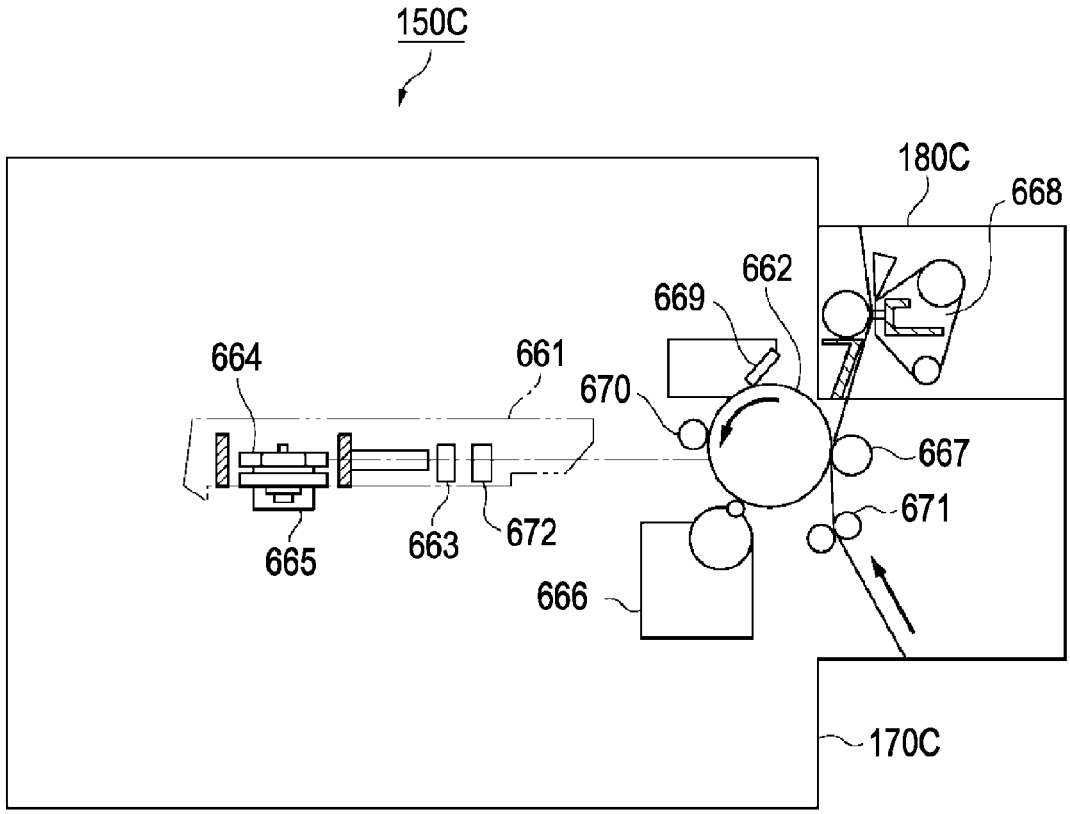
FIG. 12 is a cross-sectional view of an image forming subsystem for a 1D black and white printer.

(C) Hardware configuration of Image Forming Subsystem for 1D Black and White Printer FIG. 12 is a cross-sectional view of the detailed structure of the image forming subsystem 150C for a 1D black and white printer.

The black and white image forming subsystem 150C includes an image producing unit 170C and a fixing unit 180C. Like the 4D color image forming subsystem 150A having a vertical paper path structure, these units can be replaced with different units having the same functionality. In addition, these units can be physically separated.

First, the image producing unit 170C is described in detail.

The image producing unit 170C includes a scanner unit 661, a photoconductive drum 662, a developing unit 666, and a transfer roller 667. The scanner unit 661 incorporates a laser unit 663, a polyhedral mirror (polygon mirror) 664, a scanner motor 665, and a beam detection signal (BD signal) generating circuit 672.

Each component of the image producing unit 170C and the operation thereof are described next.

The photoconductive drum 662 includes a photoconductive layer on an aluminum drum base composed of an OPC (opto-photoconductor) and is driven by a drive unit (not shown) to rotate in a counterclockwise direction shown in FIG. 12 at a predetermined process speed. A primary charger 670 uniformly charges the surface of the photoconductive drum 662 at a predetermined potential based on a charge bias applied by a charge bias power supply (not shown).

In the scanner unit 661, the laser unit 663 emits a laser beam modulated on the basis of time-series electrical digital pixel signals of given image information. The polyhedral mirror (polygon mirror) 664 is a rotating polyhedral mirror that deflects the laser beam emitted from the laser 663 so as to scan the surface of the photoconductive drum 662 and form an electrostatic latent image on the photoconductive drum 662. The scanner motor 665 rotates the polygon mirror 664. The beam detection signal (BD signal) generating circuit 672 detects the laser beam deflected by the polygon mirror 664 in the main scanning direction.

The developing unit 666 develops the electrostatic latent image formed on the photoconductive drum 662 using a black (BK) developer material. The transfer roller 667 is in contact with the photoconductive drum 662 and transfers the developer material on the photoconductive drum 662 to the transfer medium P. A cleaning blade 669 is in contact with the photoconductive drum 662 at all times so as to strip off the residual developer material on the surface of the photoconductive drum 662. Thus, the photoconductive drum 662 is cleaned. Furthermore, like the above-described 1D color fixing system, an image-producing-unit controller (not shown) is provided to the image producing unit 170C so as to control the operation of these components of the image producing unit. Thus, the process speed of the image producing unit and density of the image can be controlled.

The fixing unit 180C is described next.

The fixing unit 180C is disposed downstream of the transfer roller 667 of the image producing unit 170C in the transport direction of the transfer medium P. Like the above-described 1D color fixing system, a fixing device 668 fixes a toner image transferred onto the transfer medium P by heating and pressing the toner image. A roller of the fixing device 668 is rotatably driven by a drive unit (not shown) and the electrical power of a halogen heater in the fixing device 668 is controlled so that the temperature of the surface of a fuser roller is controlled. Furthermore, a fixing unit controller (not shown) for controlling these components is provided to the fixing unit 180C so that the rotational speeds of the roller, the temperature of the fuser roller, and the process for abnormal conditions are controlled.

Additionally, the image forming subsystem 150C for a 1D black and white printer includes the image formation control unit 160 that communicates with the image-producing-unit controller and the fixing unit controller. Thus, the image formation control unit 160 retrieves unit information from these controllers and sends unit control information to these controllers. Furthermore, the image formation control unit 160 exchanges various image signals with the controller 250 and exchanges control information with the printer engine control unit 105 and the platform control unit 65.

While the above-described description has been made with reference to the image producing unit and the fixing unit both of which include the control units, the image producing unit and fixing unit can operate without the control units. In such a case, an image forming control unit (not shown) controls the components in the image producing unit and the fixing unit.

Configuration of Electrical Connection According to First Exemplary Embodiment

Overall Configuration

The configuration of electrical connection of an image forming apparatus according to the first exemplary embodiment is described below.

Figure 13:
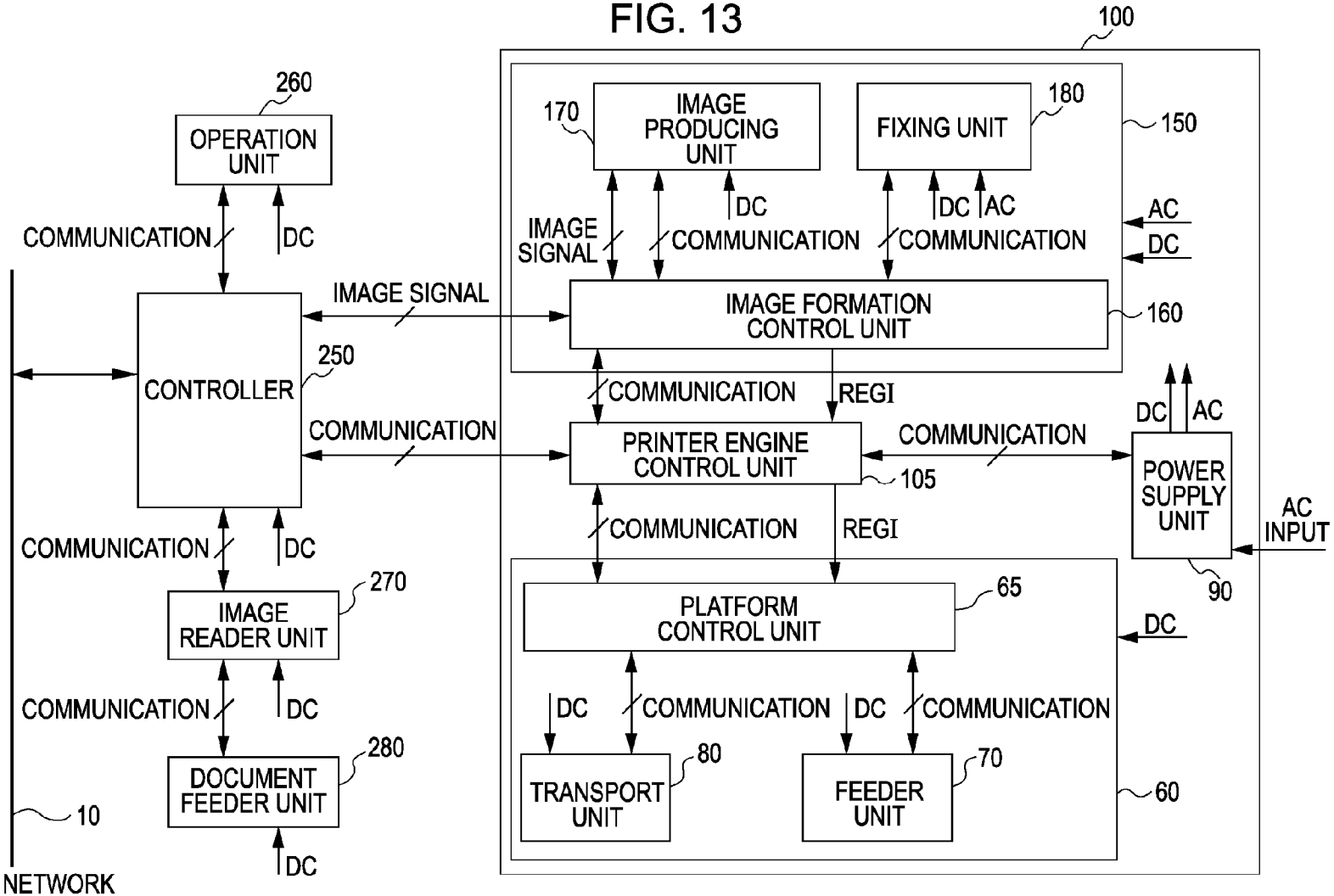
FIG. 13 is a block diagram illustrating an exemplary configuration of electrical connection of an image forming apparatus according to the first embodiment.

FIG. 13 is a block diagram illustrating the configuration of electrical connection of an image forming apparatus according to the present embodiment.

As shown in FIG. 13, the image forming apparatus includes the printer engine control unit 105 for controlling the printer engine 100 and the platform control unit 65 for controlling the paper transport platform 60. Here, the transport unit 80 includes a control unit incorporating a central processing unit (CPU) whereas the feeder unit 70 does not include a CPU.

The transport unit 80 communicates with the platform control unit 65 to exchange control information. Thus, the transport unit 80 controls the load of control components (such as the motors). Under the control of the platform control unit 65, the feeder unit 70 controls the load of control components. The feeder unit 70 controls the load associated with a feeding operation of the transfer medium P. The transport unit 80 controls the load associated with an output operation, an inverting operation, and a duplex transporting operation of the transfer medium P. Using such controls, the paper transport platform 60 achieves a transport operation of the transfer medium P to form an image.

The image formation control unit 160 controls the image forming subsystem 150. Here, the image producing unit 170 includes a control unit incorporating a CPU whereas the fixing unit 180 does not include a CPU.

The image producing unit 170 communicates with the image formation control unit 160 so as to exchange control information. Thus, the image producing unit 170 controls the load of control components. Under the control of the image formation control unit 160, the fixing unit 180 controls the control load of components. The image producing unit 170 forms an image on the transfer medium P on the basis of image signals exchanged with the controller 250. The fixing unit 180 heats and fixes the image on the transfer medium P. Examples of the exchanged image signals include video data (VIDEO), an image sync CLK (VCLK), a main scanning sync signal (BD), and a sub scanning sync signal (ITOP).

Here, the image forming subsystem 150 receives the transfer medium P transported by the paper transport platform 60. Subsequently, in order to transfer an image formed by the image forming subsystem 150 to the transfer medium P at a proper position, the image forming subsystem 150 transmits a paper transport sync signal (REGI) generated on the basis of the sub scanning sync signal (ITOP) managed by the image formation control unit 160 to the platform control unit 65 via the printer engine control unit 105. The platform control unit 65 controls the feeding and transporting operations on the basis of the paper transport sync signal (REGI) so that the transported transfer medium P is delivered to the image forming subsystem 150 at a predetermined timing. By performing such collaborative operations, the image forming subsystem 150 can achieve the image forming operation on the transported transfer medium P.

The printer engine 100 includes the power supply unit 90, which receives an AC input and outputs DC outputs and rectified AC outputs. As the DC outputs, a plurality of controlled voltage outputs are supplied to the platforms, the subsystems, and the units in the image forming apparatus. The AC outputs are supplied to the platforms, the subsystems, and the units in the image forming apparatus as needed. In this embodiment, the AC output is supplied to the fixing unit 180.

The printer engine control unit 105 manages control information on the paper transport platform 60 received via communication with the platform control unit 65, control information on the image forming subsystem 150 received via communication with the image formation control unit 160, and control information on the power supply unit 90 received from the power supply unit 90. On the basis of all the received information, the printer engine control unit 105 transmits control information to the platform control unit 65, the image formation control unit 160, and the power supply unit 90 so as to cause the printer engine to carry out an image forming operation.

The platform control unit 65 communicates control information with the transport unit 80 on the basis of the control information determined by the printer engine control unit 105. Also, the platform control unit 65 controls the load of the control components of the feeder unit 70 on the basis of the control information determined by the printer engine control unit 105. The transport unit 80 controls the load of the control components on the basis of the received control information.

The image formation control unit 160 communicates control information with the image producing unit 170 on the basis of the control information determined by the printer engine control unit 105. Also, the image formation control unit 160 controls the load of the control components of the fixing unit 180 on the basis of the control information determined by the printer engine control unit 105. The image producing unit 170 controls the load of the control components on the basis of the received control information. The power supply unit 90 controls the output voltage on the basis of the control information determined by the printer engine control unit 105.

The controller 250 exchanges image data and control information. That is, the controller 250 exchanges control information with the printer engine control unit 105 and exchanges image signals with the paper transport platform 60 of the printer engine 100. The image reader unit 270 is connected to the controller 250 to receive image information. The document feeder unit 280 is connected to the image reader unit 270 to feed documents to be read out. The operation unit 260 for inputting user operations and displaying messages is connected to the controller 250 so as to exchange control information. The controller 250 is connected to a network 10 and can communicate image signals and control information with, for example, a computer (not shown) in the network 10.

Electrical Configuration of Image Forming Subsystem

Components in the image forming apparatus, in particular, an image forming subsystem 150 and an image formation control unit 160 provided to the image forming subsystem 150 are described next.

(A) 4D Full-color Image Forming Subsystem 150A

Figure 14:
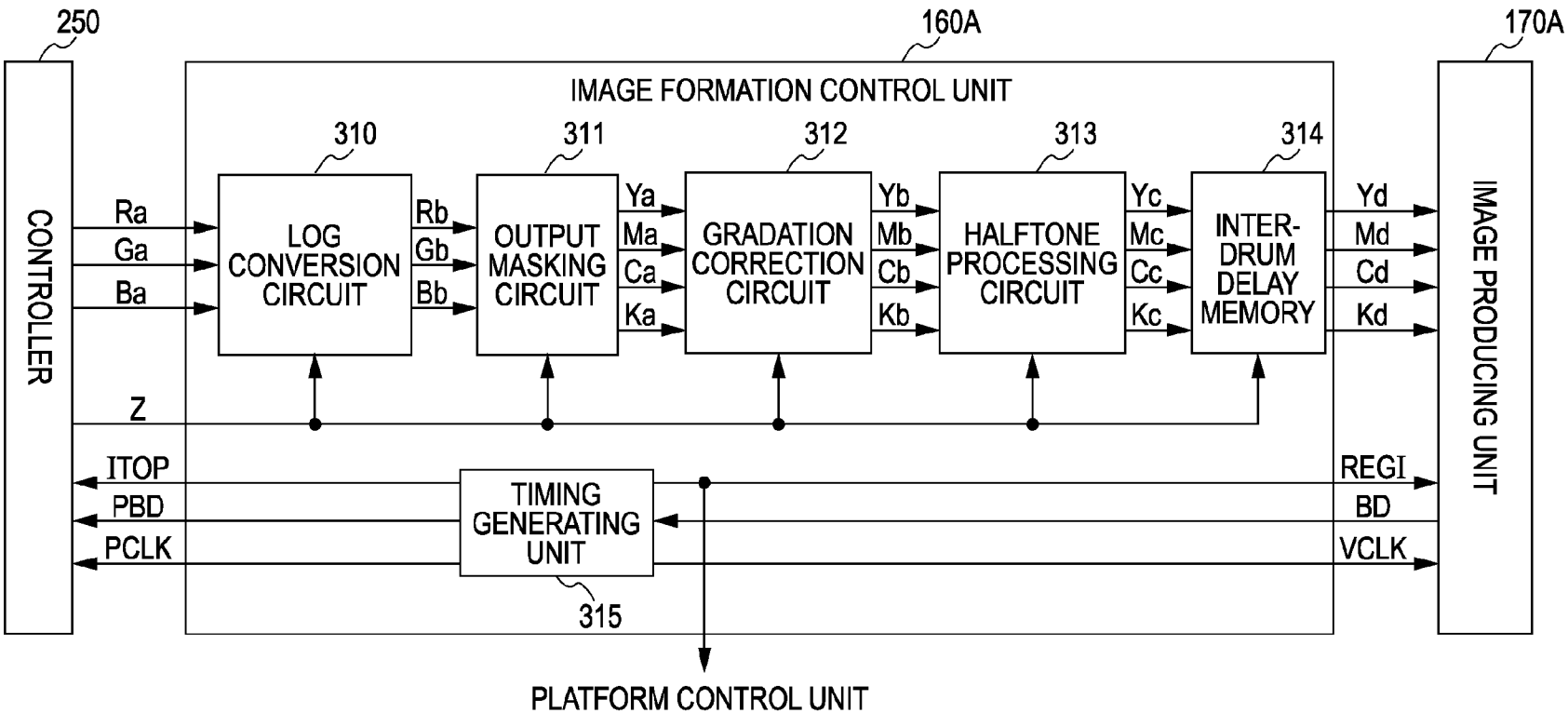
FIG. 14 is a block diagram of a 4D full-color image forming subsystem.

FIG. 14 is a block diagram of a 4D full-color image forming subsystem 150A.

The 4D full-color image forming subsystem 150A includes an image formation control unit 160A including an image processing unit, an image producing unit 170A, and a fixing unit 180A. An image signal is input from the controller 250 to the image formation control unit 160A in the form of an RGB color format. Thereafter, the image signal is processed as follows.

First, the image signal is subjected to a density conversion by a LOG conversion circuit 310 and is converted to YMCK data by an output masking circuit 311. The output masking circuit 311 carries out the conversion so that the average color difference in a Lab space is minimal. The coefficient of the conversion depends on the hardware characteristics of the image producing unit 170A. The YMCK data is input to a gradation correction circuit 312, which corrects the gradation of the YMCK data using a lookup table (hereinafter referred to as an "LUT"). In the LUT, a table for correcting the hardware characteristics (such as an individual difference and a change over time), a density adjustment table that can be changed by a user, and an image mode table (such as a character mode and a print paper mode) are combined.

The LUT varies in accordance with a subsequent halftone process. Since a halftone processing circuit 313 carries out a plurality of halftone processes in parallel, the gradation correction circuit 312 has a number of LUTs equal to the number of parallel processings performed by the halftone processing circuit 313. Thus, the gradation correction circuit 312 carries out all the halftone processes and outputs all the processing results at the same time. The gradation-corrected signal is input to the halftone processing circuit 313, which generates print data. The halftone processing circuit 313 carries out error diffusion and a plurality of screen processes in parallel. One of the screens is selected and output in accordance with a Z signal, which is described below. The print data is subject to a delaying operation in accordance with the arrangement of the drums by an inter-drum delay memory 314 and is output to the image producing unit 170A.

The Z signal for indicating the features of the image is input to the image formation control unit 160A from the controller 250 at the same time as the image signal. The Z signal is a signal synchronized with the RGB signal. The Z signal is input to the LOG conversion circuit 310, the output masking circuit 311, the gradation correction circuit 312, and the halftone processing circuit 313. The Z signal includes data indicating the features on a page-by-page basis and data indicating the features on a pixel-by-pixel basis. More specifically, the data on a page-by-page basis is data identifying a copy image or a PDL image whereas the data on a pixel-by-pixel basis is data identifying a character/photograph and a BMP/object.

The image output timing of the controller 250 is controlled by the image sync signals ITOP and a PBD signal output from a timing generating unit 315. The ITOP signal is a sync signal in the sub scanning direction. The PBD signal is a sync signal in the main scanning direction. In addition, an image clock PCLK is input to the controller 250. The controller 250 outputs image signal in synchronization with the image clock PCLK. The PBD signal is generated on the basis of the BD signal output from the image producing unit 170A.

The timing generating unit 315 further generates an REGI signal for controlling the driving timing of a registration roller. The REGI signal is output to the image producing unit 170A, which includes the registration roller. The REGI signal is generated on the basis of the ITOP signal. The timing of the ITOP signal is determined depending on a relationship among the image producing position, the transfer position, and the registration roller. Thus, the timing of the ITOP signal is uniquely determined for the image forming subsystem 150A. The REGI signal is also delivered to the platform control unit 65 at the same time in order to synchronize with the registration roller.

(B) Image Forming Timing of 4D Full-color Image Forming Subsystem

Figure 15:
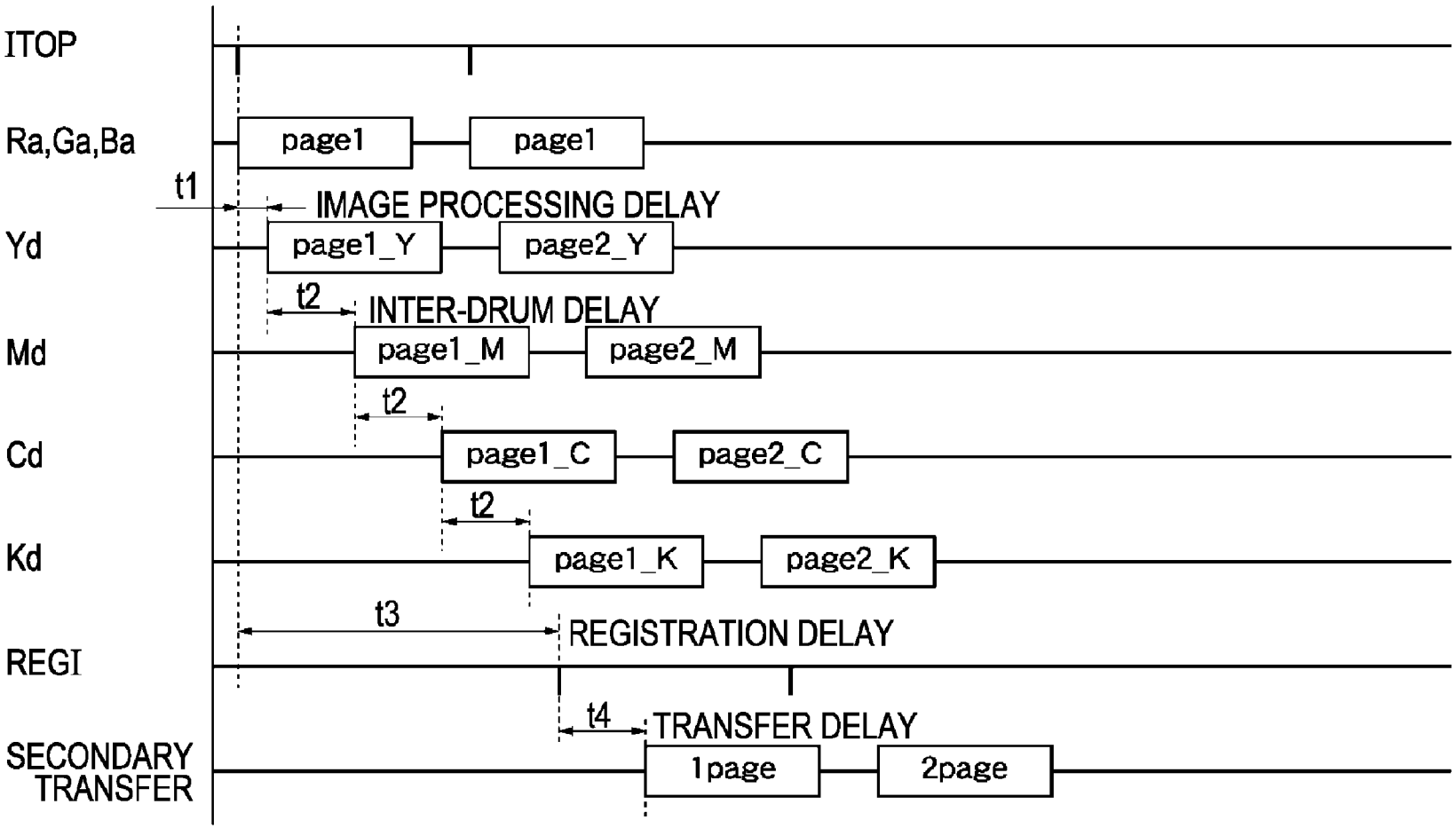
FIG. 15 is a timing diagram illustrating the image forming timing of the 4D full-color image forming subsystem.

FIG. 15 is a timing diagram illustrating the image forming timing of the 4D full-color image forming subsystem 150A.

In FIG. 15, images for two pages are continuously produced. RGB images are output from the controller 250 in accordance with the ITOP timings. After an image processing delay t1 has elapsed, YMCK data are sequentially output to the image producing unit 170A. The YMCK data have a phase difference of t2, which is the time delay of an inter-drum. The delaying operation is carried out by the inter-drum delay memory 314.

The timing generating unit 315 generates the REGI signal after a registration delay t3 has elapsed from the time the ITOP signal was generated. At that time, the registration roller is driven so that the transfer medium P is transported to the secondary transfer unit. The secondary transfer starts after a transfer delay t4 has elapsed from the time the REGI signal occurs. The process of the second page starts during the transfer operation of the first page. If more pages are present, the above-described process is repeated in the same manner.

(C) Electric Configuration of 1D Full-color Image Forming Subsystem

Figure 16:
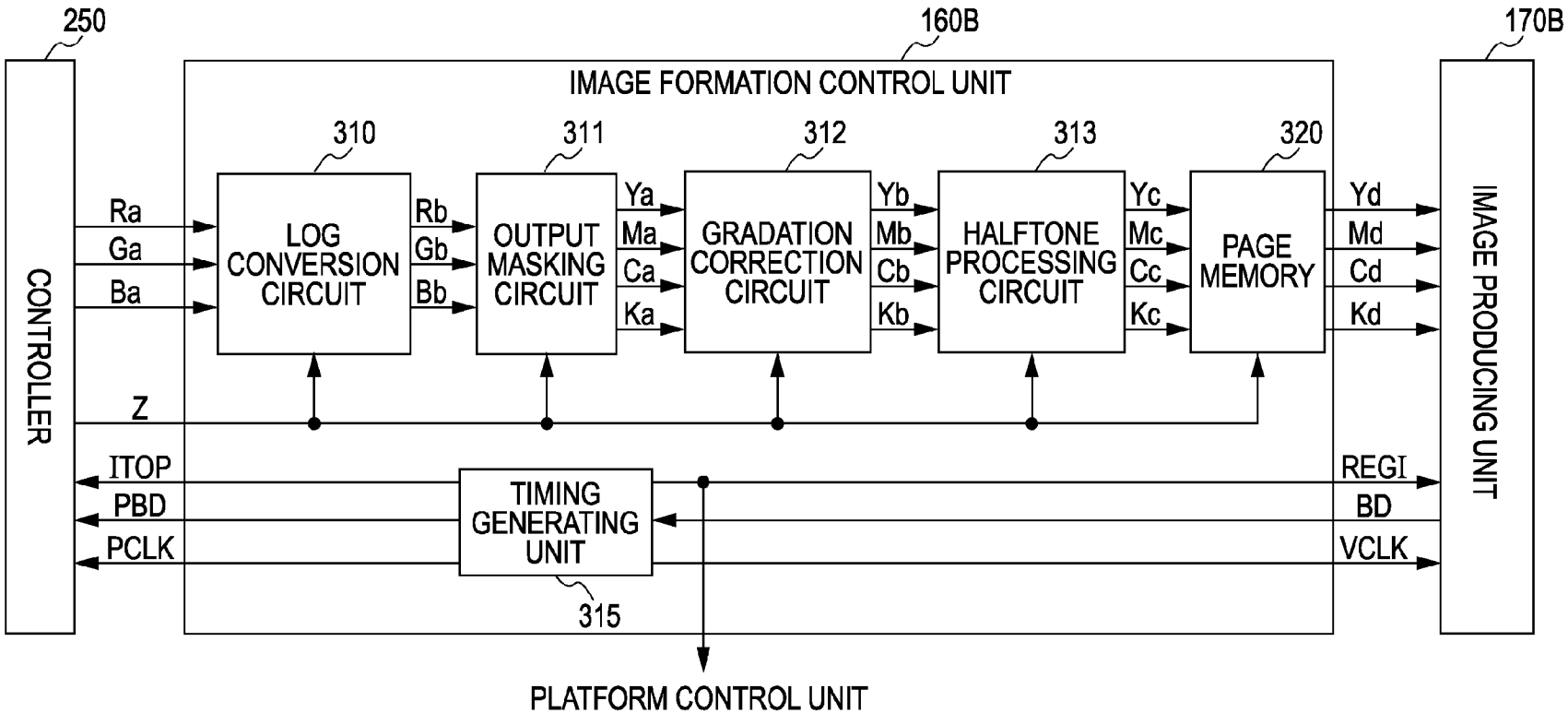
FIG. 16 is a block diagram of a 1D full-color image forming subsystem.

FIG. 16 is a block diagram of a 1D full-color image forming subsystem 150B.

The 1D full-color image forming subsystem 150B includes an image formation control unit 160B including an image processing unit, the image producing unit 170B, and a fixing unit 180B. An image signal is input from the controller 250 to the image formation control unit 160B in the form of an RGB color format. Thereafter, the image signal is processed as follows.

The difference between the image processing performed by the 1D full-color image forming subsystem 150B shown in FIG. 16 and that performed by the 4D full-color image forming subsystem 150A shown in FIG. 14 is that the inter-drum delay memory 314 is changed to a page memory 320. Other blocks are similar to those of the 4D full-color image forming subsystem 150A, and therefore, descriptions thereof are not repeated.

(D) Image Forming Timing of 1D Full-Color Image Forming Subsystem

Figure 17:
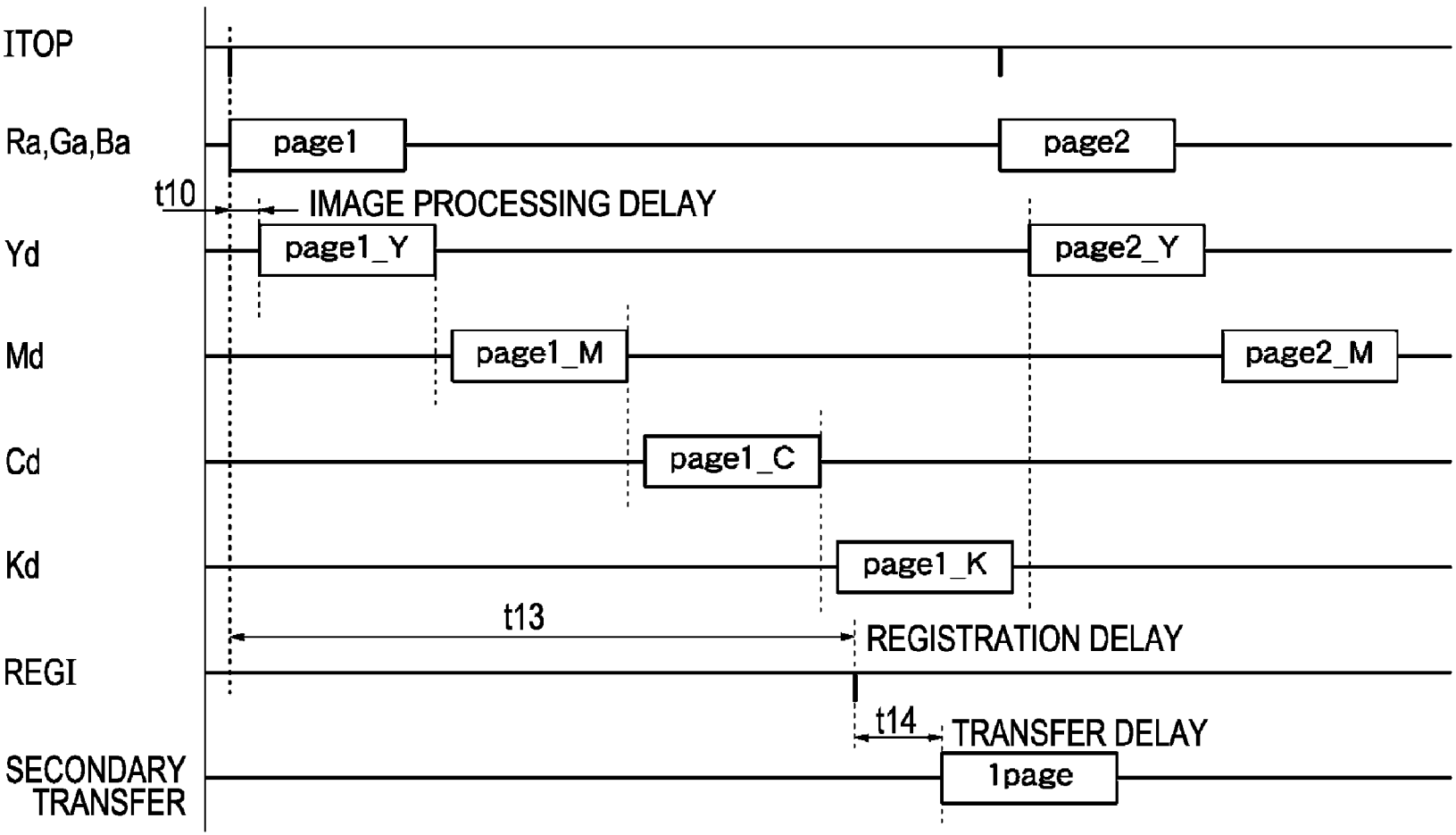
FIG. 17 is a timing diagram illustrating the image forming timing of the 1D full-color image forming subsystem.

FIG. 17 is a timing diagram illustrating the image forming timing of the 1D full-color image forming subsystem 150B.

In FIG. 17, images for two pages are continuously produced. RGB images are output from the controller 250 in accordance with the ITOP timing. After an image processing delay t1 has elapsed, YMCK print data is stored in the page memory 320. The YMCK data are sequentially delivered to the image producing unit 170B. According to this configuration, an image is formed for each color. Therefore, after image formation for all colors are completed, the next print data is supplied.

The timing generating unit 315 generates the REGI signal after a registration delay t3 has elapsed from the time the ITOP signal was generated. At that time, the registration roller is driven so that the transfer medium P is transported to the secondary transfer unit. The secondary transfer starts after a transfer delay t4 has elapsed from the time the REGI signal occurs. The process of the second page starts at a certain time so that the image formation of the fourth color for the first page does not overlap the image formation of the first color for the second page. If more pages are present, the above-described process is repeated in the same manner.

(E) Electrical Configuration of 1D Black and White Image Forming Subsystem

Figure 18:
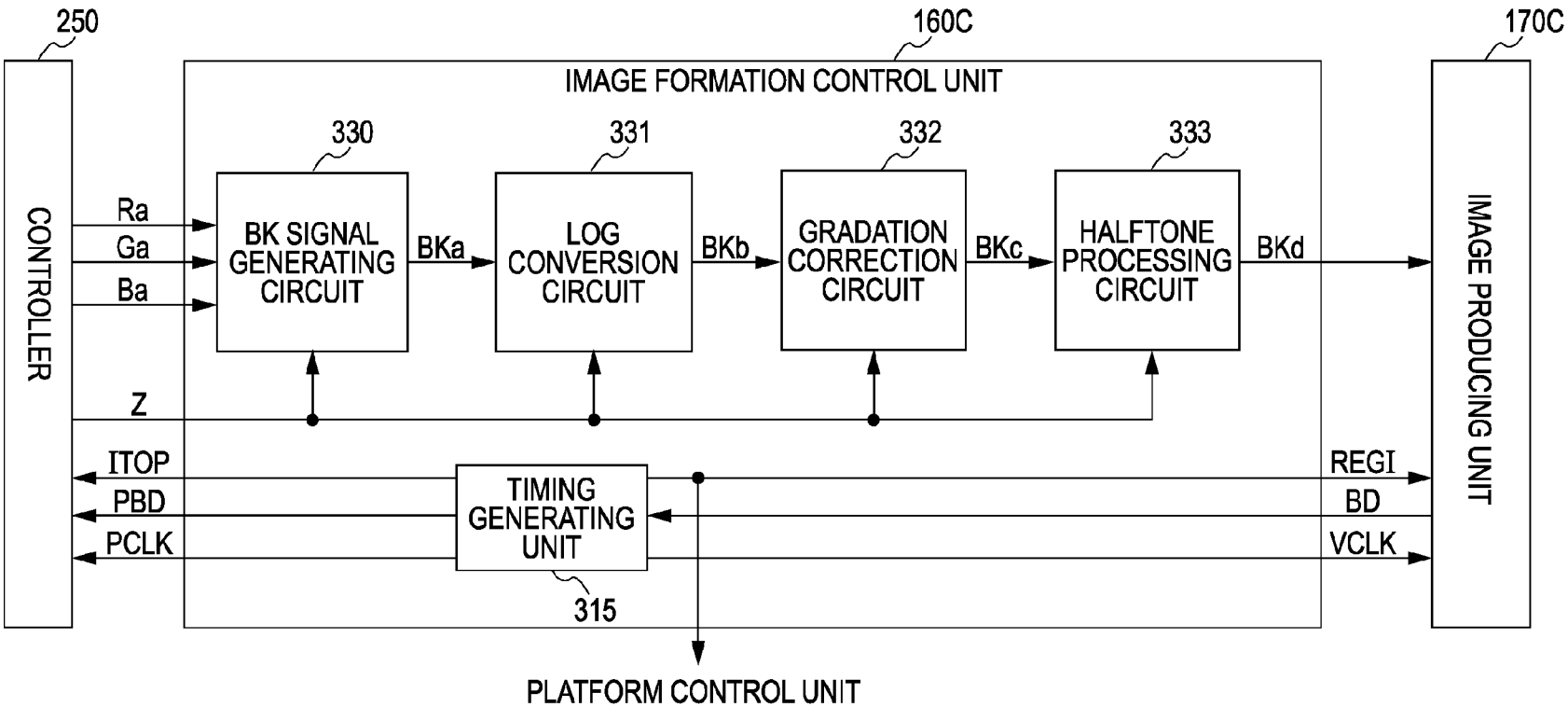
FIG. 18 is a block diagram of a 1D black and white image forming subsystem.

FIG. 18 is a block diagram of a 1D black and white image forming subsystem 150C.

The 1D full-color image forming subsystem 150C includes an image formation control unit 160C including an image processing unit, the image producing unit 170C, and a fixing unit 180C. Like the full-color image forming subsystems, an image signal is input from the controller 250 to the image formation control unit 160C in the form of an RGB color format. The image formation control unit 160C generates a BK signal.

First, a BK generating circuit 330 converts the RGB signal to the BK signal. Thereafter, the BK signal is subject to a density conversion by a LOG conversion circuit 331 and is subjected to gradation correction by a gradation correction circuit 332. Finally, a halftone processing circuit 333 generates print data from the BK signal.

The functions of the LOG conversion circuit 331, the gradation correction circuit 332, and the halftone processing circuit 333 are similar to those of the full-color image forming subsystems except that the number of channels is one (for BK single color).

(F) Image Forming Timing of 1D Black and White Image Forming Subsystem

Figure 19:
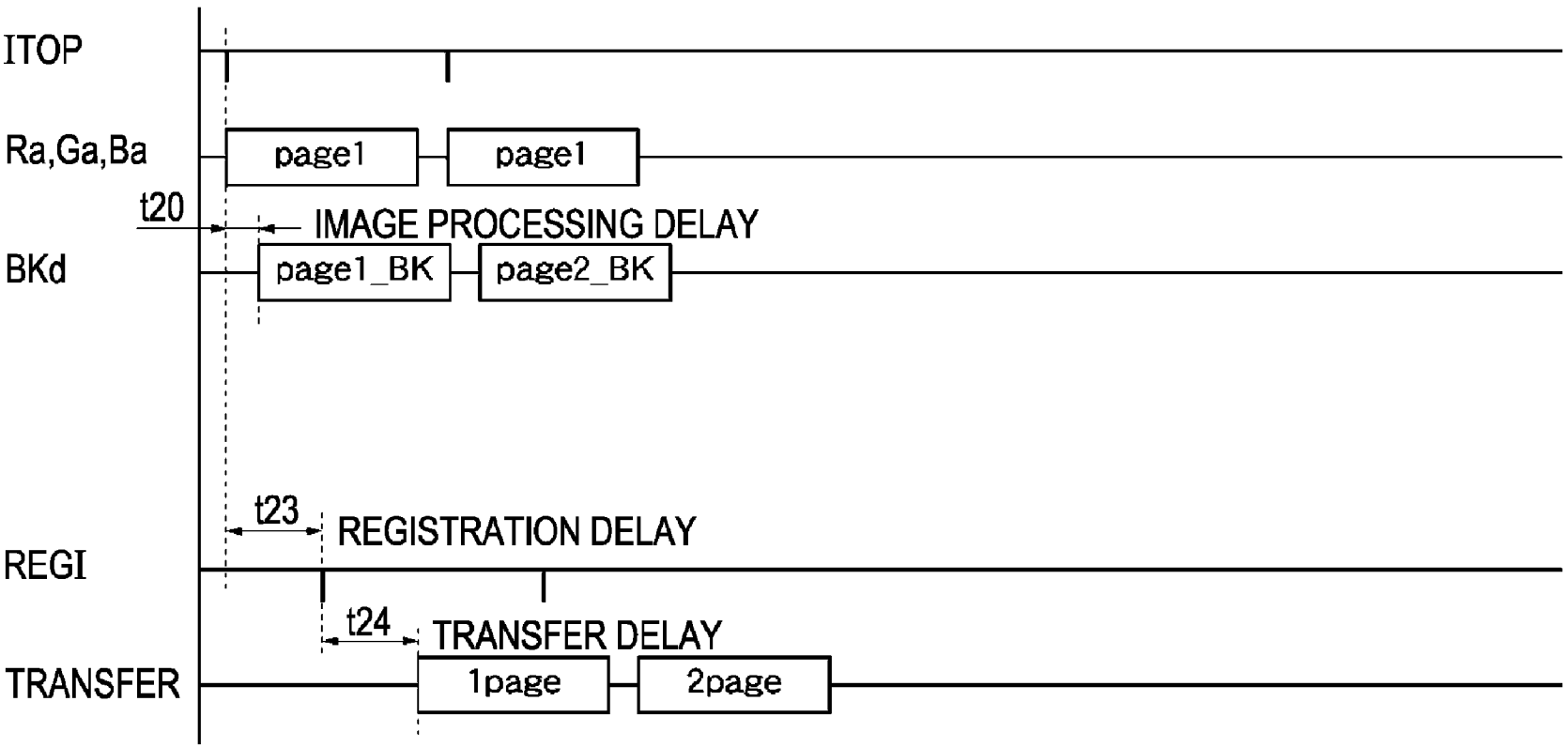
FIG. 19 is a timing diagram illustrating the image forming timing of the 1D black and white image forming subsystem.

FIG. 19 is a timing diagram illustrating the image forming timing of the 1D black and white image forming subsystem 150C.

In FIG. 19, images for two pages are continuously produced. RGB images are output from the controller 250 in accordance with the ITOP timings. After an image processing delay t20 has elapsed, BK data is output to the image producing unit 170C. The timing generating unit 315 generates the REGI signal after a registration delay t23 has elapsed from the time that the ITOP signal was generated. At that time, the registration roller is driven so that the transfer medium P is transported to the transfer unit. The transfer starts after a transfer delay t24 has elapsed from the time the REGI signal occurs.

The process of the second page starts during the transfer operation of the first page. If more pages are present, the above-described process is repeated in the same manner.

Operation according to First Exemplary Embodiment

Simplex Image Forming Operation Corresponding to High-Speed Color Throughput The simplex image forming operation performed by the printer engine 100 is described next for a case in which the above-described image forming subsystem 150A corresponding to a high-speed color throughput is mounted on the paper transport platform 60.

Upon receiving a user instruction for starting an image forming procedure via the operation unit 260 of the image forming apparatus, the printer engine control unit 105 transmits a paper feed request command to the platform control unit 65. Thereafter, the transport unit 80 and the feeder unit 70 start the operations. Similarly, when the printer engine control unit 105 transmits an image forming request command to the image formation control unit 160, the image producing unit 170A and the fixing unit 180A start an image forming operation. The photoconductive drums 602A, 602B, 602C, and 602D of the image forming units, 601Y, 601M, 601C, and 601BK, which are rotatably driven at a predetermined process speed by a driving mechanism of the image producing unit 170A, are uniformly and negatively charged by the primary chargers 603A, 603B, 603C, and 603D, respectively. Thereafter, the laser exposure unit 607 emits externally input color-separated image signals from a laser emitting element to the polygon mirror 618 rotatably driven by the scanner motor 617. Thus, the image signals reflected by the reflection mirror form electrostatic latent images for four colors on the photoconductive drums 602A, 602B, 602C, and 602D, respectively.

Subsequently, yellow toner is deposited on the electrostatic latent image formed on the photoconductive drum 602A by the developing unit 604A to which a developing bias having the same polarity as the charged polarity of the photoconductive drum 602A (i.e., negative polarity) is applied. Thus, the electrostatic latent image is visualized as a toner image. This yellow toner image is primary-transferred onto the moving intermediate transfer belt 608 by the transfer roller 605A to which a primary transfer bias having a polarity opposite to that of the primary transfer biased toner (i.e., positive polarity) is applied in the primary transfer unit 615A disposed between the photoconductive drum 602A and the transfer roller 605A.

The intermediate transfer belt 608 having the yellow toner image formed thereon is moved towards the image forming unit 601M. Similarly, in the image forming unit 601M, a magenta toner image formed on the photoconductive drum 602B is transferred to the intermediate transfer belt 608 while overlapping the yellow toner image by the primary transfer unit 615B.

At that time, residual toner on the photoconductive drums 602A, 602B, 602C, and 602D is removed and collected, for example, by cleaner blades provided to the drum cleaners 606A, 606B, 606C, and 606D, respectively.

Similarly, cyan and black toner images, which are formed on the photoconductive drums 602C and 602D of the image forming units 601C and 601BK, respectively, are sequentially overlapped on the overlap-transferred yellow and magenta toner images on the intermediate transfer belt 608. Thus, a full-color toner image is formed on the intermediate transfer belt 608.

In synchronization with the time when the leading edge of the full-color toner image on the intermediate transfer belt 608 is moved to the secondary transfer unit 616 disposed between the secondary transfer counter roller 609 and the secondary transfer roller 611, the feeder cassette 505 of a feeder unit 60A is selected. Then, the top sheet of the transfer media P stacked in the feeder cassette 505 is picked up by the pickup roller 502 and is transported to the paper feed path 511. Additionally, the transport roller 503 delivers the transported transfer medium P to a registration roller 613 of the image producing unit 170A. Subsequently, the registration roller 613 of the image producing unit 170A delivers the transfer medium P to the secondary transfer unit 616. The full-color toner image is secondary-transferred to the transfer medium P transported to the secondary transfer unit 616 by the secondary transfer roller 611 to which a secondary transfer bias having a polarity opposite to that of the toner (i.e., positive polarity) is applied.

The transfer medium P having the full-color toner image formed thereon is transported to the fixing unit 180A. In a fixing nip unit 614 disposed between the fuser roller 612A and the pressure roller 612B, the full-color toner image is affixed to the surface of the transfer medium P by heating and pressing the full-color toner image. Thereafter, the transfer medium P is transported to the transport unit 80A. The transfer medium P then passes through the paper output path 525 of the transport unit 80A and is output onto the output tray 527 disposed on the top of the image forming apparatus by the paper output roller 522. Thus, the series of image forming operations is completed.

So far, the simplex image forming operation has been described.

Duplex Image Forming Operation Performed by Image Forming Apparatus corresponding to High-Speed Color Throughput The duplex image forming operation performed by image forming apparatus corresponding to high-speed color throughput is described next.

The processes before the transfer medium P is delivered to the fixing unit 180A are similar to those for the simplex image forming operation. In the fixing nip unit 614 disposed between the fuser roller 612A and the pressure roller 612B, the full-color toner image is heated and pressed and is heat-fixed to the surface of the transfer medium P. Thereafter, the transfer medium P passes through the paper output path 525 of the transport unit 80A. When most of the transfer medium P is output onto the output tray 527 disposed on the top of the image forming apparatus by the paper output roller 522, the rotation of the paper output roller 522 is stopped. At that time, the trailing edge of the transfer medium P is located at a reversible position of the transfer medium P, that is, at a position downstream of the branching position of the paper output path 525 and the transport path 526.

Subsequently, in order to deliver the transfer medium P, which is stopped due to the stop of the rotation of the paper output path 525, to the transport path 526 having the transport rollers 523 and 524, the paper output roller 522 rotates in a direction opposite to the direction of the simplex image forming operation. By rotating the paper output roller 522 in the reverse direction, the trailing edge of the transfer medium P, which is located at the reversible position, becomes the leading edge and reaches the transport roller 523.

Thereafter, the transport roller 523 transports the transfer medium P to the transport roller 524. The transfer medium P is then transported to the paper feed path 511 of the feeder unit 60A. The transport roller 503 transports the delivered transfer medium P to the registration roller 613 of the image producing unit 170A. During the transportation, the printer engine control unit 105 transmits an image forming request command to the image formation control unit 160. Like the above-described simplex image forming operation, in synchronization with the time when the leading edge of the full-color toner image on the intermediate transfer belt 608 moves to the secondary transfer unit 616 disposed between the secondary transfer counter roller 609 and the secondary transfer roller 611, the registration roller 613 moves the transfer medium P to the secondary transfer unit 616.

After the leading edge of the toner image is aligned with the leading edge of the transfer medium P in the secondary transfer unit 616 and the toner image is transferred to the transfer medium P, the fixing unit 180A fixes the image onto the transfer medium P, as in the simplex image formation. The transfer medium P is then transported by the paper output roller 522 of the transport unit 80A again. Finally, the transfer medium P is output onto the output tray 527. Thereafter, the series of image forming operations is completed.

Simplex Image Forming Operation corresponding to Low-Speed Color Throughput

The simplex image forming operation performed by the printer engine 100 is described next for a case in which the above-described image forming subsystem 150B corresponding to a low-speed color throughput is mounted in the engine platform 101 to form the printer engine 100 along with the paper transport platform 60.

Upon receiving a user instruction of starting an image forming job via the operation unit 260 of the image forming apparatus, the printer engine control unit 105 transmits a paper feed request command to the platform control unit 65. Thereafter, the transport unit 80 and the feeder unit 70 start the operations. Similarly, when the printer engine control unit 105 transmits an image forming request command to the image formation control unit 160, the photoconductive drum 632 is rotatably driven by a driving mechanism (not shown) of the image producing unit 170B at a predetermined process speed. In addition, the photoconductive drum 632 is uniformly charged to a negative polarity by the primary charger 642.

Thereafter, the scanner unit 631 emits externally input color-separated image signals from a laser emitting element to the polygon mirror 635 rotatably driven by the scanner motor 636. Thus, the image signals reflected by the reflection mirror form a yellow (Y) electrostatic latent image on the photoconductive drum 632. At a position at which the photoconductive drum 632 is in contact with the yellow (Y) developer unit 637A in the developing rotary 637, the latent image is visualized using the yellow (Y) developer material. The photoconductive drum 632 is further rotated by the driving mechanism and reaches a position at which the photoconductive drum 632 is in contact with the intermediate transfer belt 633. At that point, the yellow (Y) developer material is primary-transferred to the moving intermediate transfer belt 633 by a transfer roller 630 to which a primary transfer bias having a polarity opposite to that of the toner (i.e., positive polarity) is applied. At that time, residual toner on the photoconductive drum 632 is removed, for example, by the cleaner blade 639 provided to a drum cleaner unit and is collected into a recycling container. Thereafter, a driving unit (not shown) rotates the developing rotary 637 about 90 degrees to prepare for the next print operation for magenta (M).

To produce an image from magenta (M) data, a latent image for the magenta (M) data is written onto the photoconductive drum 632, as in the formation of the yellow (Y) data. Subsequently, the driving mechanism rotates the photoconductive drum 632. Additionally, the primary charger 642 uniformly and negatively charges the photoconductive drum 632. The scanner unit 631 then emits externally input color-separated image signals from the laser emitting element to the polygon mirror 635 rotatably driven by the scanner motor 636. Thus, the image signals reflected by the reflection mirror form a magenta (M) electrostatic latent image on the photoconductive drum 632. At the rotational position of the intermediate transfer belt 633 that is the same as that in the yellow (Y) image formation, the latent image on the photoconductive drum 632 is visualized using the magenta (M) developer material. The photoconductive drum 632 is further rotated by the driving mechanism and reaches a certain position at which the photoconductive drum 632 is in contact with the intermediate transfer belt 633. At that point, the magenta (M) developer material is primary-transferred to the moving intermediate transfer belt 633 by a transfer roller 644 to which a primary transfer bias having a polarity opposite to that of the toner (i.e., positive polarity) is applied.

Subsequently, a similar image forming steps are carried out for cyan (C) and black (BK). When the yellow (y), magenta (M), cyan (C), and black (BK) developer materials overlap at a predetermined position, the feeder cassette 505 of a feeder unit 70B is selected. Then, the top sheet of the transfer media P stacked in the feeder cassette 505 is picked up by the pickup roller 502 and is transported to the paper feed path 511. Additionally, the transport roller 503 delivers the transported transfer medium P to a registration roller 641 of the image producing unit 170B. Subsequently, the registration roller 641 of the image producing unit 170B delivers the transfer medium P to a secondary transfer unit formed by the secondary transfer roller 638 and the intermediate transfer belt 633. The full-color toner image is secondary-transferred to the transfer medium P transported to the secondary transfer unit by the secondary transfer roller 638 to which a secondary transfer bias having a polarity opposite to that of the toner (i.e., positive polarity) is applied.

The transfer medium P having the full-color toner image formed thereon is transported to the fixing unit 180B. In the fixing unit 180B, the full-color toner image is heated and pressed and is heat-fixed to the surface of the transfer medium P by the fixing device 640. Thereafter, the transfer medium P is transported to the transport unit 80B. The transfer medium P then passes through the paper output path 525 of the transport unit 80B and is output onto the output tray 527 disposed on the top of the image forming apparatus by the paper output roller 522. Thus, the series of image forming operations is completed.

So far, the simplex image forming operation has been described.

Duplex Image Forming Operation Corresponding to Low-Speed Color Throughput

The duplex image forming operation corresponding to low-speed color throughput is described next.

The processes before the transfer medium P is delivered to the fixing unit 180B are similar to those of the simplex image forming operation. In the fixing device 640, the full-color toner image is heated and pressed and is heat-fixed to the surface of the transfer medium P. Thereafter, the transfer medium P passes through the paper output path 525 of the transport unit 80B. When most of the transfer medium P is output onto the output tray 527 disposed on the top of the image forming apparatus by the paper output roller 522, the rotation of the paper output roller 522 is stopped. At that time, the trailing edge of the transfer medium P is located at a reversible position of the transfer medium P, that is, at a position downstream of the branching position of the paper output path 525 and the transport path 526.

Subsequently, in order to deliver the transfer medium P, which is stopped due to the stop of the rotation of the paper output path 525, to the transport path 526 having the transport rollers 523 and 524, the paper output roller 522 rotates in a direction opposite to the direction of the simplex image forming operation. By rotating the paper output roller 522 in the reverse direction, the trailing edge of the transfer medium P, which is located at the reversible position, becomes the leading edge and reaches the transport roller 523.

Thereafter, the transport roller 523 transports the transfer medium P to the transport roller 524. The transfer medium P is then transported to the paper feed path 511 of the feeder unit 60B. The transport roller 503 transports the delivered transfer medium P to the registration roller 613 of the image producing unit 170B. During the transportation, the printer engine control unit 105 transmits an image forming request command to the image formation control unit 160. Like the above-described simplex image forming operation, in synchronization with the time when the leading edge of the full-color toner image on the intermediate transfer belt 608 moves to the secondary transfer unit 616 disposed between the secondary transfer counter roller 609 and the secondary transfer roller 611, the registration roller 613 moves the transfer medium P to the secondary transfer unit 616.

After the leading edge of the toner image is aligned with the leading edge of the transfer medium P in the secondary transfer unit 616 and the toner image is transferred to the transfer medium P, the fixing unit 180B fixes the image onto the transfer medium P, as in the simplex image formation. The transfer medium P is then transported by the paper output roller 522 of the transport unit 80B again. Finally, the transfer medium P is output onto the output tray 527. Thereafter, the series of image forming operations is completed.

Simplex Image Forming Operation corresponding to High-Speed Black and White Throughput The image forming operation performed by the printer engine 100 is described next for a case in which the above-described image forming subsystem 150C corresponding to a high-speed black and white throughput is mounted in the engine platform 101 to form the printer engine 100 along with the paper transport platform 60.

Upon receiving a user instruction for starting an image forming procedure via the operation unit 260 of the image forming apparatus, the printer engine control unit 105 transmits a paper feed request command to the platform control unit 65. Thereafter, the transport unit 80 and the feeder unit 70 start the operations. Similarly, when the printer engine control unit 105 transmits an image forming request command to the image formation control unit 160, the photoconductive drum 662 is rotatably driven by a driving mechanism (not shown) of the image producing unit 170C at a predetermined process speed. In addition, the photoconductive drum 662 is uniformly charged to a negative polarity by the primary charger 670.

Thereafter, the scanner unit 661 externally emits input image signals from a laser emitting element to the polygon mirror 664 rotatably driven by the scanner motor 665. Thus, the image signals reflected by the reflection mirror form an electrostatic latent image on the photoconductive drum 662. At a position at which the photoconductive drum 662 is in contact with the developing unit 666, the latent image on the photoconductive drum 662 is visualized using the developer material. Additionally, the feeder cassette 505 of a feeder unit 70A is selected. Then, the top sheet of the transfer media P stacked in the feeder cassette 505 is picked up by the pickup roller 502 and is transported to the paper feed path 511. Additionally, the transport roller 503 delivers the transported transfer medium P to a registration roller 671 of the image producing unit 170A. Subsequently, the toner image is transferred to the transfer medium P transported to a transfer unit 34 by the transfer roller 667 to which a secondary transfer bias having a polarity opposite to that of the toner (i.e., positive polarity) is applied. The transfer medium P having the toner image formed thereon is transported to the fixing unit 180C. In the fixing unit 180C, the toner image is heated and pressed and is heat-fixed to the surface of the transfer medium P by the fixing device 668. Thereafter, the transfer medium P is transported to the transport unit 80A. The transfer medium P then passes through the paper output path 525 of the transport unit 80A and is output onto the output tray 527 disposed on the top of the image forming apparatus by the paper output roller 522. Thus, the series of image forming operations is completed. Furthermore, at that time, residual toner on the photoconductive drum 662 is removed, for example, by a cleaner blade 669 provided to a drum cleaner unit and is collected into a recycling container.

So far, the simplex image forming operation has been described.

Duplex Image Forming Operation Corresponding to High-Speed Black and White Throughput The duplex image forming operation corresponding to the above-described low-speed color throughput is described next.

The processes before the transfer medium P is delivered to the fixing unit 180C are similar to those for the simplex image forming operation. In the fixing device 668, the toner image is heated and pressed and is heat-fixed to the surface of the transfer medium P. Thereafter, the transfer medium P passes through the paper output path 525 of the transport unit 80A. When most of the transfer medium P is output onto the output tray 527 disposed on the top of the image forming apparatus by the paper output roller 522, the rotation of the paper output roller 522 is stopped. At that time, the trailing edge of the transfer medium P is located at a reversible position of the transfer medium P, that is, at a position downstream of the branching position of the paper output path 525 and the transport path 526.

Subsequently, in order to deliver the transfer medium P, which is stopped due to the stop of the rotation of the paper output path 525, to the transport path 526 having the transport rollers 523 and 524, the paper output roller 522 rotates in a direction opposite to the direction of the simplex image forming operation. By rotating the paper output roller 522 in the reverse direction, the trailing edge of the transfer medium P, which is located at the reversible position, becomes the leading edge and reaches the transport roller 523.

Thereafter, the transport roller 523 transports the transfer medium P to the transport roller 524. The transfer medium P is then transported to the paper feed path 511 of the feeder unit 60A. The transport roller 503 transports the delivered transfer medium P to the registration roller 671 of the image producing unit 170C. During the transportation, the printer engine control unit 105 transmits an image forming request command to the image formation control unit 160. Thus, like the above-described simplex image forming operation, the transfer medium P is moved to a transfer unit by the registration roller 613.

After the leading edge of the toner image is aligned with the leading edge of the transfer medium P in the transfer unit and the toner image is transferred to the transfer medium P, the fixing unit 180C fixes the image onto the transfer medium P, as in the simplex image formation. The transfer medium P is then transported by the paper output roller 522 of the transport unit 80A again. Finally, the transfer medium P is output onto the output tray 527. Thereafter, the series of image forming operations is completed.

Communication Data used for Image Forming Operation and Timing of Communication Data (A) Parameter of Configuration Communication when Power is turned ON The communication data and the timing of the communication data used for communication between the printer engine control unit 105 and the image formation control unit 160 in the image forming subsystem 150, between the printer engine control unit 105 and the platform control unit 65 in the paper transport platform 60, and between the printer engine control unit 105 and the power supply unit 90 in order to achieve the image forming operation performed by the printer engine 100 are described next with reference to FIGS. 20A to 24B.

FIGS. 20A-C, 21A, and 21B illustrate parameters of the configuration communication when the power is turned ON.

Data structure 701 shown in FIG. 20A illustrate data that is common to the configuration information data for all the units. The configuration information data is transmitted to the printer engine control unit 105 when the power is turned ON. When the power supply unit 90 starts supplying the power and the printer engine control unit 105 and the platform control unit 65 start the operations thereof, the configuration information data is transmitted from the platform control unit 65 to the printer engine control unit 105, and similarly, from the image formation control unit 160 to the printer engine control unit 105. The transmitted configuration information data is used for notifying the printer engine control unit 105 of the capabilities of the platform control unit 65 and the image formation control unit 160.

For example, the transmitted configuration information data includes the following data items: a unit ID for identifying a unit associated with this transmitted configuration information data and a process speed at which the unit can operate. At that time, for example, when the image forming subsystem 150 is capable of performing color printing, the process speed for the fixing operation may vary depending on the selection of a full-color mode or a black color mode even when the same type of the transfer medium P is used. Accordingly, in order to properly notify the printer engine control unit 105 of the capabilities of the image forming subsystem 150, a data set including information about the process speed and the color mode (full-color or black-color mode) needs to be transmitted. In contrast, in most cases for the paper transport platform, the capability of transporting the transfer medium P does not vary regardless of mode (full-color mode or black color). Therefore, at that time, the process speed is sent together with information indicating that the process speed is applied to both full-color mode and black-color mode.

Additionally, when the type of transfer medium P is different, for example, when a thick paper sheet and a plain paper sheet are compared, the fixing conditions and the transport conditions for the paper sheets tend to be different. Therefore, the process speed needs to be sent for each type of transfer medium P. That is, a set of the material condition and the process speed needs to be sent.

Furthermore, since a required fixing heater temperature depends on the color mode and material conditions, data about the color mode and material conditions needs to be sent together with data about electric power consumed by the unit under these conditions.

Accordingly, the sent configuration data in the data structure 701 contains a set of the process speed, the color mode which determines the process speed, the power consumption, and the material conditions.

The data structure 701 shown in FIG. 20A illustrates an example in which three types of process speed are sent. However, for a unit that requires only one type of process speed, one speed should be sent. Furthermore, since the distance between the transfer media P (i.e., an inter-print gap) may vary depending on the transport conditions associated with the type of unit (e.g., a sensor response time and a fixing performance), the data structure 701 contains that data as the data to be sent.

A data structure 702 shown in FIG. 20B illustrates available electric power supply data that is sent from the power supply unit 90 to the printer engine control unit 105. According to the present exemplary embodiment, since the image forming apparatus includes the interchangeable image forming subsystem 150 and the paper transport platform 60 having different capabilities, the data about the available electric power supply from the power supply unit 90 and the configuration data about the power supply system are important for determining whether the power supply unit 90 can supply sufficient electric power to the units. Accordingly, like the data in the data structure 701, these data should be sent to the printer engine control unit 105 when the power is turned on.

A data structure 703 shown in FIG. 20C illustrates data about the capability of the image forming subsystem 150 that the image formation control unit 160 should send in addition to the data in the configuration data structure 701. More specifically, this data represents configuration information indicating the selection of a 4D color image forming subsystem (e.g., the 4D color image forming subsystem 150A) or a 1D color image forming subsystem (e.g., the 1D color image forming subsystem 150B). Additionally, for the color image forming subsystems (such as the image forming subsystem 150A or 150B), in order to develop and transfer four color images, ITOP signals for the four colors need to be generated at an appropriate time period. An "ITOP period" field represents such data. Furthermore, for the color image forming subsystems, in order to align the position of the image data with the position of the transfer medium P, the following data may be required: a time period from the time when an ITOP signal for controlling color image data of a given page that is developed first is generated to the time when the image for the fourth color is developed and transferred and the head of the image data for subscanning reaches a secondary transfer unit (150A) formed by the secondary transfer roller 611 and the intermediate transfer belt 608 or a secondary transfer unit (150B) formed by the secondary transfer roller 638 and the intermediate transfer belt 633. This data can be contained in the data structure 703 as needed.

A data structure 704 shown in FIG. 21A illustrates data on printer engine operating conditions determined by the printer engine control unit 105 in order to allow the printer engine 100 to function as an image forming apparatus. For example, the following operating conditions can be derived from the data structure 704: operating conditions for allowing all the units to normally operate and allowing the printer engine 100 to stably operate as an image forming apparatus on the basis of the process speed and power consumption data determined by the color mode/material conditions sent from the paper transport platform 60 and the image forming subsystem 150 using the data structures 701 and 703 and the available power supply data using the data structure 702. Additionally, the printer engine control unit 105 may prestore some operating conditions as default values and select the operating conditions that are consistent with the data collected from the units. In the example shown by the data structure 704, process speeds and PPMs (print per minute) for three color mode/material conditions are determined. In addition, a combination of the color mode and a material that is not supported can be sent as needed.

A data structure 705 shown in FIG. 21B illustrates data sent from the image formation control unit 160 and the platform control unit 65 to the printer engine control unit 105 again after the image formation control unit 160 and the platform control unit 65 receive the operating conditions from the printer engine control unit 105 and redetermine the power consumption under the received conditions. The printer engine control unit 105 uses this data for comparing the available electric power received from the power supply unit 90 using the data structure 702 with the sum of electric power consumed by the units under the determined conditions and then determining the operability or correcting the conditions.

So far, the parameters of the configuration communications when the power is on have been described.

In the foregoing description, it has been assumed that each unit of the paper transport platform 60 and the image forming subsystem 150, for example, the image producing unit 170 and the fixing unit 180 of the image forming subsystem 150 have no control unit (controller) (such as a CPU). That is, the subsystem itself stores and controls the capability information about its accompanying units. However, if the accompanying units include control units (controllers) thereof, the platform control unit 65 and the image forming subsystem 150 may receive the configuration information having the data structure 701 from the accompanying units and put this information together. Subsequently, the platform control unit 65 and the image forming subsystem 150 may communicate this information with the printer engine control unit 105.

(B) Command Sequence of Configuration Information when Power is Turned ON

Figure 22A:
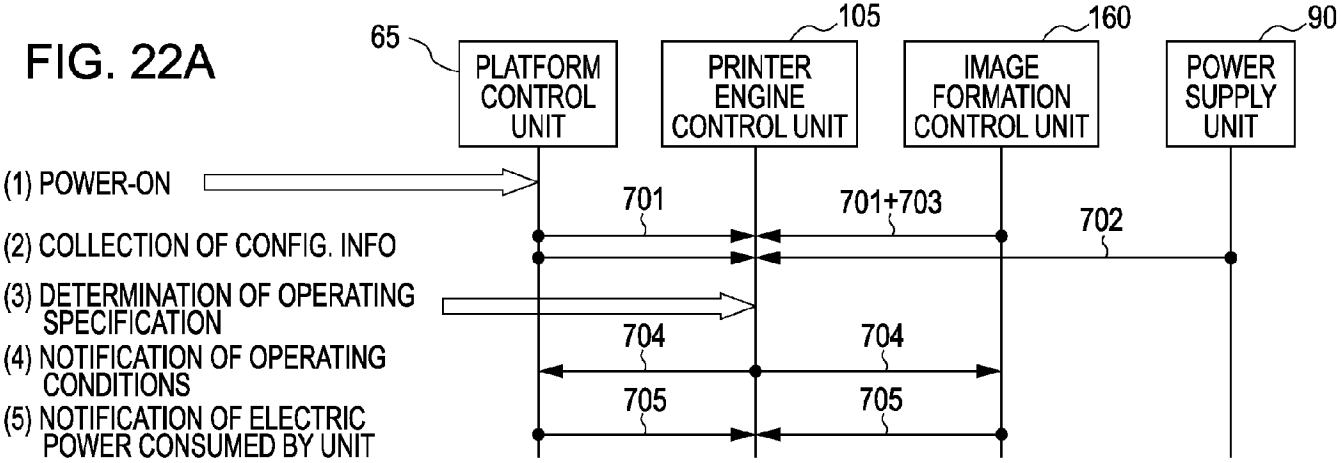
Figure 22B:
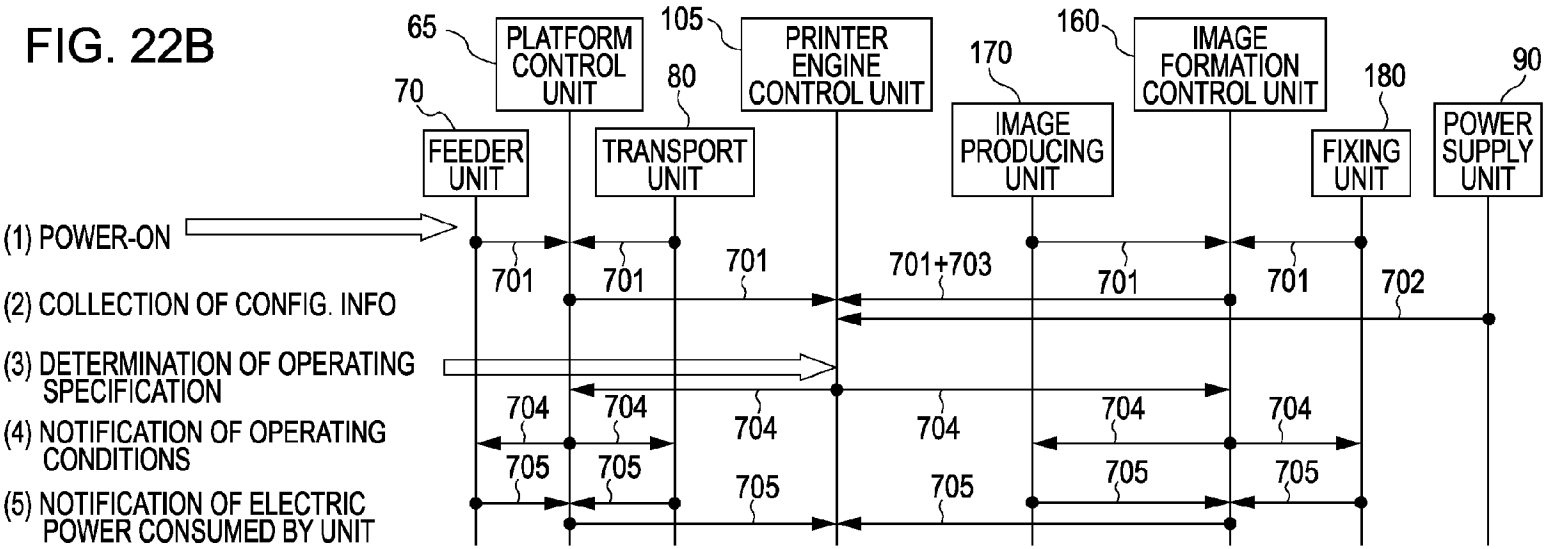

FIGS. 22A and 22B illustrate the command sequence of the configuration information in detail when the power is turned on.

In an example shown in FIG. 22A, the paper transport platform 60 and the image forming subsystem 150 function as a system that stores and controls the capability information about its accompanying units.

When a power switch SW (not shown) is turned on and the power supply unit 90 supplies power to the units, the platform control unit 65 and the image formation control unit 160 transmit the capability information based on the data structure 701 to the printer engine control unit 105 as configuration data. At that time, the image formation control unit 160 appends the data indicated by the data structure 703 to the data indicated by the data structure 701. At almost the same time as this data communication, the power supply unit 90 transmits the available electric power data based on the data structure 702 to the printer engine control unit 105.

On the basis of the received configuration data, the printer engine control unit 105 determines the operating conditions for the image forming apparatus (such as process speeds and the PPM for each of materials and the color mode). Thereafter, the printer engine control unit 105 transmits the determined operating conditions to the platform control unit 65 and the image formation control unit 160 using the data structure 704.

The platform control unit 65 and the image formation control unit 160 operate under the operating conditions based on the data in the data structure 704 and prepare the image forming operation (e.g., generation of the operation parameters). At the same time, the platform control unit 65 and the image formation control unit 160 recalculate the power consumption under the provided operating conditions. The platform control unit 65 and the image formation control unit 160 then transmit the calculation result to the printer engine control unit 105 using the data structure 705.

After the above-described command sequence is carried out, a series of the configuration communication when the power is on is completed.

FIG. 22B illustrates an example of a sequence when the units accompanying the paper transport platform 60 and the image forming subsystem 150 include control units (controllers) thereof.

When a power SW (not shown) is turned on and the power supply unit 90 supplies power to the units, the feeder unit 70 and the transport unit 80 accompanying the platform control unit 65 transmit the capability information based on the data structure 701 to the platform control unit 65 as configuration data. Similarly, the fixing unit 180 accompanying the image formation control unit 160 transmits the capability information based on the data structure 701 to the image formation control unit 160. The image producing unit 170 transmits the data indicated by the data structure 703 to the image formation control unit 160 in addition to the data indicated by the data structure 701.

On the basis of the capability information transmitted from the feeder unit 70 and the transport unit 80, the platform control unit 65 determines the capability information thereof. The image formation control unit 160 carries out the similar operation. Thereafter, to the printer engine control unit 105, the platform control unit 65 transmits the capability information based on the data structure 701 and the image formation control unit 160 transmits the capability information based on the data structure 703 in addition to the capability information based on the data structure 701 as the configuration data. At almost the same time as the data communication, the power supply unit 90 transmits the available electric power data based on the data structure 702 to the printer engine control unit 105.

On the basis of the received configuration data, the printer engine control unit 105 determines the operating conditions for an image forming apparatus (such as a process speed and a PPM for each of materials and the color modes).

Thereafter, the printer engine control unit 105 transmits the determined operating conditions to the platform control unit 65 and the image formation control unit 160 using the data structure 704. The platform control unit 65 and the image formation control unit 160 operate under the operating conditions based on the data in the data structure 704 and transmit that information to the accompanying feeder unit 70, the transport unit 80, the image producing unit 170, and the fixing unit 180.

The feeder unit 70, the transport unit 80, the image producing unit 170, and the fixing unit 180 recognize requests to operate under the provided operating conditions and prepare the image forming operation (e.g., generation of the operation parameters). At the same time, the feeder unit 70, the transport unit 80, the image producing unit 170, and the fixing unit 180 recalculate the power requirements under the provided operating conditions. The feeder unit 70, the transport unit 80, the image producing unit 170, and the fixing unit 180 then transmit the calculation result to the platform control unit 65 and the image formation control unit 160 using the data structure 705.

Each of the platform control unit 65 and the image formation control unit 160 computes the sum of electric power on the basis of the consumed power data transmitted from the accompanying units and then transmits the computation result to the printer engine control unit 105 using the data structure 705.

After the above-described command sequence is carried out, a series of the configuration communication when the power is turned on is completed.

(C) Communication Parameter and Command Sequence During Image Forming Operation

Figure 24A:
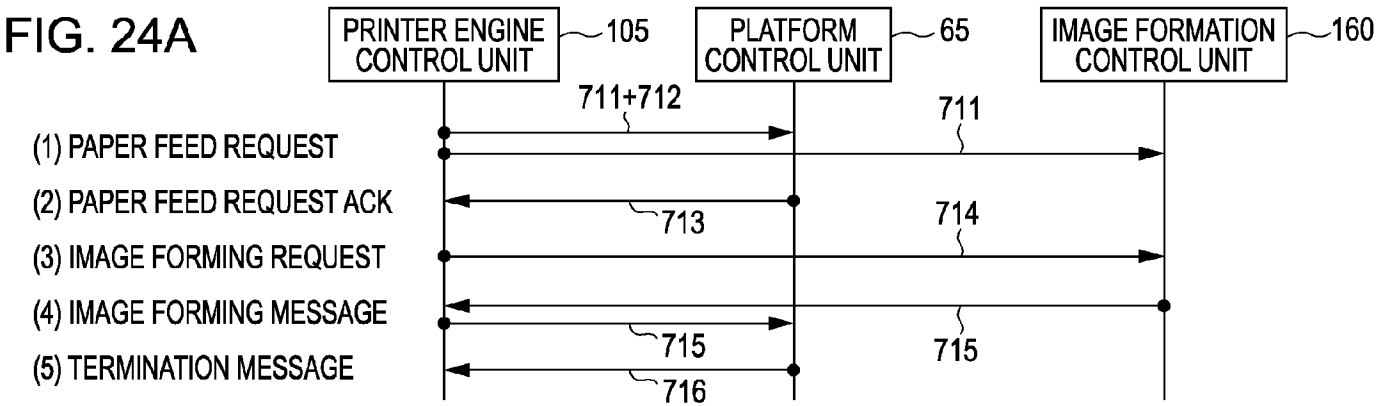
FIGS. 24A and 24B illustrate the command sequence during the image forming operation.
Figure 24B:
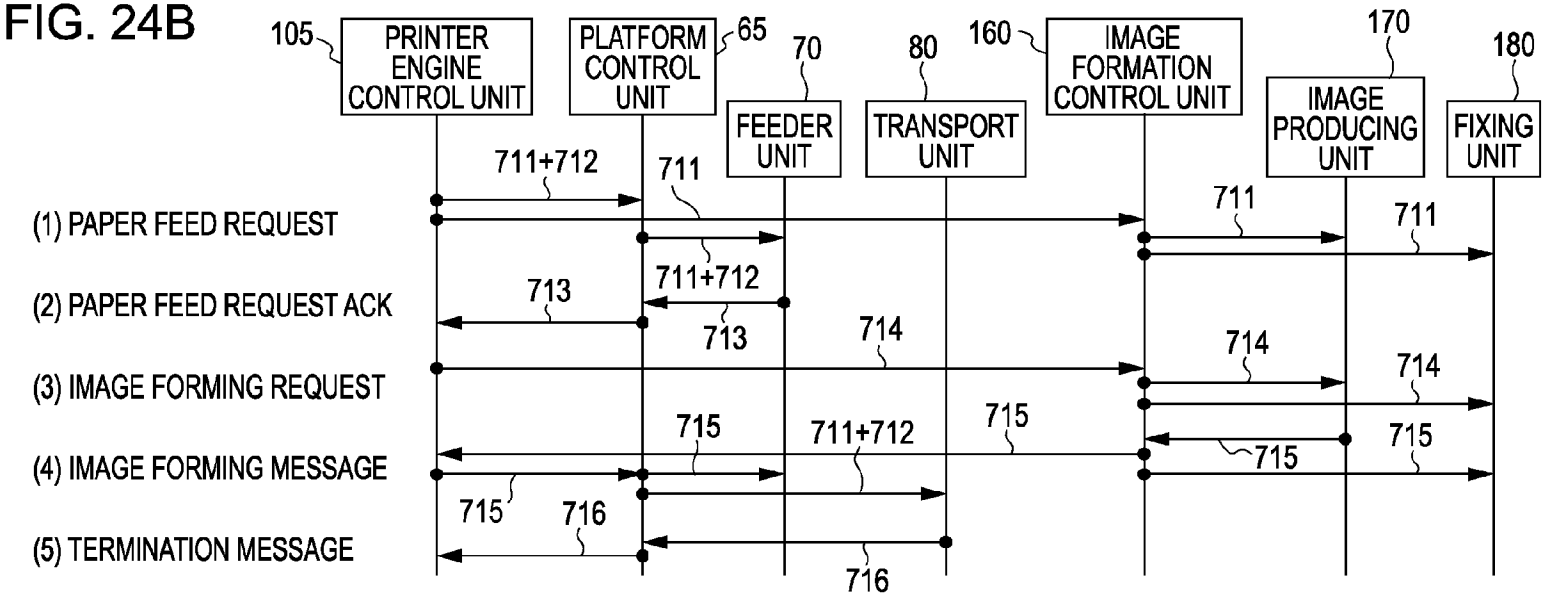

The communication parameters and command sequence between the units during an image forming operation performed by the printer engine 100 are described next with reference to FIGS. 23A-F and FIGS. 24A and 24B. FIGS. 23A-F illustrate communication parameters exchanged between the units during the image forming operation. FIGS. 24A and 24B illustrate a communication command sequence during the image forming operation.

A data structure 711 shown in FIG. 23A is common part of the paper-feed request commands and the parameters transmitted from the printer engine control unit 105 to the platform control unit 65 and the image formation control unit 160 in order to start transporting the transfer medium P during the image forming operation.

Since command data shown in the data structure 711 relates to a paper feed request, this data can be transmitted only to the platform control unit 65. Alternatively, this data can be also transmitted to the image formation control unit 160 in order to make an appointment to form an image. In this exemplary embodiment, the data is also transmitted to the image formation control unit 160 in order to make an appointment to form an image.

Examples of data required for the paper-feed start request in the data structure 711 include a command ID that indicates a paper-feed start request command, a page ID corresponding to requesting image data, a color mode, a paper size, material information, a printed surface (one side, a first side of two sides, a second side of two sides).

Command data shown by a data structure 712 shown in FIG. 23B is data to be transmitted that is not necessary for the image formation control unit 160 as appointment information on the image forming operation, but is necessary for the platform control unit 65 to control the transport of the transfer medium P and is not included in the command data in the data structure 711. More specifically, this command data includes feeder station information and an output direction required for transporting the transfer medium P in the transport unit.

A data structure 713 shown in FIG. 23C represents paper-feed request ACK command data used for the platform control unit 65 to inform the printer engine control unit 105 of the determination result of start of the paper feed operation. The parameters of the command include a page ID, feeder station information, feed status information indicating whether the paper feed normally starts or not, and "NOT OK" factor information indicating the cause of failure when the paper feed does not normally start. Examples of the cause include the paper presence status, the error status, and a paper jam status. In addition, in this exemplary embodiment, the time when the platform control unit 65 transmits the paper-feed request ACK command indicates the time when the start of image formation is allowed.

A data structure 714 shown in FIG. 23D represents image-formation request command data that is transmitted from the printer engine control unit 105 to the image formation control unit 160 when the platform control unit 65 informs the printer engine control unit 105 of the start of paper feed using the data structure 713. When the printer engine control unit 105 is ready for image formation, the printer engine control unit 105 issues this command. Examples of the parameter include a page ID and a color mode.

A data structure 715 shown in FIG. 23E represents an image forming operation start notification command sent from the image formation control unit 160 to inform the printer engine control unit 105 of the start of the image forming operation after the image formation control unit 160 receives the image forming request using the data structure 714. In accordance with the configuration of the image formation control unit 160, the image formation control unit 160 generates the ITOP signal serving as a trigger that starts the image forming operation. At the same time, the image formation control unit 160 issues this image forming operation start notification command. Upon receiving this command based on the data structure 715, the printer engine control unit 105 transmits this data structure 715 to the platform control unit 65 in order to control the transport of the transfer medium P. Examples of the parameter include a page ID.

A data structure 716 shown in FIG. 23F represents data of an image formation and transport termination acknowledgment command sent from the platform control unit 65 when the platform control unit 65 detects the completion of the image forming operation and transport operation. At that time, the transfer medium P may be output to outside the apparatus or the transfer medium P may remain in the apparatus due to a paper jam. On the basis of this command, the printer engine control unit 105 determines whether the image formation of the target image (page) is normally completed or not. Examples of the parameter include a completion status indicating a normal completion or abnormal completion and a "not OK" cause indicating the cause of the abnormal completion. Examples of the "not OK" cause include an error status and a jam status.

So far, the parameters of the command data communicated between the printer engine control unit 105 and the platform control unit 65 and between the printer engine control unit 105 and the image formation control unit 160 during an image forming operation have been described in detail.

In the foregoing description, it has been assumed that each unit of the paper transport platform 60 and the image forming subsystem 150, for example, the image producing unit 170 or the fixing unit 180 of the image forming subsystem 150 has no control unit (controller) (such as a CPU). That is, the subsystem itself controls its accompanying units. However, if the accompanying units include control units (controllers) thereof, the platform control unit 65 and the image formation control unit 160 may transmit command data to the accompanying units thereof on the basis of the received command data at appropriate timings so that the accompanying units partially control the image forming operation. When needed, the platform control unit 65 and the image formation control unit 160 may receive the result of the image forming operation from the accompanying units and, subsequently, communicate with the printer engine control unit 105.

The command sequence during an image forming operation is described in detail next with reference to FIGS. 24A and 24B.

In the present exemplary embodiment, the description is provided when a typical 1-page image forming operation normally starts and ends.

FIG. 24A illustrates an example of the sequence when the paper transport platform 60 and the image forming subsystem 150 control the accompanying units thereof. To start the image forming operation, the printer engine control unit 105 transmits a paper feed request command to the platform control unit 65 and the image formation control unit 160. At that time, the printer engine control unit 105 transmits the data represented by the data structure 712 and the data represented by the data structure 711 to the platform control unit 65. The printer engine control unit 105 transmits the data represented by the data structure 711 to the image formation control unit 160.

Upon receiving the paper feed request command, the platform control unit 65 determines whether the platform control unit 65 can start feeding the paper. The platform control unit 65 then transmits the result of the determination as a paper feed request ACK command represented by the data structure 713 to the printer engine control unit 105. Examples of conditions that allow the start of the paper feed include the presence of the transfer medium P and the non-occurrence of a jam of the transfer medium P previously fed.

Upon receiving the paper feed request ACK command 713 and determining that the platform control unit 65 can start feeding the transfer medium P, the printer engine control unit 105 transmits an image formation start request represented by the data structure 714 to the image formation control unit 160.

Upon receiving the image formation start request represented by the data structure 714, the image formation control unit 160 determines the period of image formation obtained from the PPM setting value and the elapsed time since the previous image formation was completed. If the image formation control unit 160 determines that the image formation can be carried out, the image formation control unit 160 generates the ITOP signal so as to start the image forming operation. At the same time, the image formation control unit 160 transmits an image forming operation start notification represented by the data structure 715 to the printer engine control unit 105.

Upon receiving the image forming operation start notification represented by the data structure 715 and recognizing that the image formation normally starts, the printer engine control unit 105 transmits the data represented by the data structure 715 to the platform control unit 65 in order to control the transport of the transfer medium P. Upon receiving the data represented by the data structure 715, the platform control unit 65 recognizes that the transport of the target transfer medium P is controlled by the registration roller and the transfer to the transfer medium P is controlled by the secondary transfer units 16 and 34. At the same time, the image formation control unit 160 controls the registration roller so that the position of the developed image is aligned with the position of the transfer medium P after a predetermined time elapses from the time the ITOP signal is generated. The image formation control unit 160 also transmits a registration signal to the platform control unit 65 to inform the platform control unit 65 of the start of the transport operation of the transfer medium P. Upon receiving the registration signal, the platform control unit 65 starts driving the load (such as the driving motor) upstream of the registration roller.

After the platform control unit 65 and the image formation control unit 160 control the image forming operation and the transport operation, the target transfer medium P is delivered from the image forming subsystem 150 to the paper transport platform 60. Subsequently, upon recognizing that the transfer medium P is output from the paper transport platform 60 to outside the apparatus, the platform control unit 65 issues an image forming and transport termination command represented by the data structure 716 to the printer engine control unit 105.

Upon receiving the image forming and transport termination command represented by the data structure 716, the printer engine control unit 105 recognizes that the series of image forming operations for the transfer medium P corresponding to the target image has been completed.

So far, the details of a command sequence from the start to the end of a 1-page image forming operation in the system in which the paper transport platform 60 and the image forming subsystem 150 control the accompanying units thereof have been described.

FIG. 24B illustrates an example of the sequence when the units accompanying the paper transport platform 60 and the image forming subsystem 150 include dedicated control units (dedicated controllers). To start the image forming operation, the printer engine control unit 105 transmits a paper feed request command to the platform control unit 65 and the image formation control unit 160. At that time, the printer engine control unit 105 transmits the data represented by the data structure 712 as well as the data represented by the data structure 711 to the platform control unit 65. The printer engine control unit 105 transmits the data represented by the data structure 711 to the image formation control unit 160.

Upon receiving the paper feed request command, the platform control unit 65 directly transmits the received paper feed request command 711 and the data represented by the data structure 712 to the feeder unit 70.

In addition, the image formation control unit 160 directly transmits the received paper feed request command 711 to the image producing unit 170 and the fixing unit 180.

Upon receiving the paper feed request command, the feeder unit 70 determines whether the feeder unit 70 can start feeding the paper. The feeder unit 70 then transmits the result of the determination as a paper feed request ACK command represented by the data structure 713 to the platform control unit 65. Examples of condition that allows the start of the paper feed include the presence of the transfer medium P and the non-occurrence of a jam of the transfer medium P previously fed.

Similarly, the platform control unit 65 transmits a paper feed request ACK command having the data structure 713 that is the same as the paper feed request ACK command received from the feeder unit 70 to the printer engine control unit 105. Upon receiving the paper feed request ACK command 713 and recognizing that the platform control unit 65 can start feeding paper, the printer engine control unit 105 transmits an image formation start request having the data structure 714 to the image formation control unit 160.

The image formation control unit 160 transmits the received image formation start request command 714 to the image producing unit 170 and the fixing unit 180 without changing any information. Upon receiving the image formation start request having the data structure 714, the image producing unit 170 determines a period of image formation obtained from the PPM setting value and an elapsed time since the previous image formation has been completed. If the image producing unit 170 determines that the image formation can be carried out, the image producing unit 170 generates the ITOP signal so as to start the image forming operation. At the same time, the image producing unit 170 transmits an image forming operation start message having the data structure 715 to the image formation control unit 160.

The image formation control unit 160 transmits a message that is the same as the image forming operation start message having the data structure 715 transmitted from the image producing unit 170 to the printer engine control unit 105. Similarly, the image formation control unit 160 transmits the image forming operation start message having the data structure 715 to the fixing unit 180 in order to inform the fixing unit 180 of the arrival of the transfer medium P since the image producing unit 170 starts the image forming operation.

The printer engine control unit 105 receives the image forming operation start message having the data structure 715 and recognizes that the image forming operation starts normally. The printer engine control unit 105 then transmits the image forming operation start message having the data structure 715 to the platform control unit 65 in order to control the transport of the transfer medium P. Upon receiving the data having the data structure 715, the platform control unit 65 transmits data that is the same as the image forming operation start message having the data structure 715 to the feeder unit 70.

Upon receiving the data represented by the data structure 715, the platform control unit 65 and the feeder unit 70 recognize that the transport of the target transfer medium P is controlled by the registration roller and the transfer to the transfer medium P is controlled by the secondary transfer units 16 and 34. At the same time, the image producing unit 170 controls the registration roller so that the position of the developed image is aligned with the position of the transfer medium P after a predetermined time passes since the ITOP signal is generated. The image producing unit 170 also transmits a registration signal to the platform control unit 65 via the image formation control unit 160 so as to inform the platform control unit 65 of the start of the transport operation of the transfer medium P. Upon receiving the registration signal, the platform control unit 65 sends the registration signal to the feeder unit 70 without delay so that the feeder unit 70 starts driving the load (such as the driving motor) upstream of the registration roller.

When the transfer medium P is delivered from the image forming subsystem 150 to the paper transport platform 60 after a predetermined time has elapsed from the time the platform control unit 65 received the image forming operation start message having the data structure 715, the platform control unit 65 sends a paper feed start request command generated from the information already received in the data structures 711 and 712 to the transport unit 80. Thus, the transport unit 80 prepares for receiving the transfer medium P.

Subsequently, the transport unit 80 receives the transfer medium P and transports the transfer medium P. Finally, upon recognizing that the transfer medium P is output to outside the apparatus, the transport unit 80 issues an image forming and transport termination command represented by the data structure 716 to the platform control unit 65.

Upon receiving the image forming and transport termination command represented by the data structure 716, the platform control unit 65 transmits a message having the same information as the received image forming and transport termination command to the printer engine control unit 105. Upon receiving the received image forming and transport termination command having the data structure 716, the printer engine control unit 105 recognizes that the series of image forming operations for the transfer medium P corresponding to the target image has been completed.

So far, the details of a command sequence from the start to the end of a 1-page image forming operation have been described when the units accompanying the paper transport platform 60 and the image forming subsystem 150 include dedicated control units thereof.

Advantages of Present Embodiment

When users purchase an image forming apparatus (such as a copier), the users are forced to select a desired one from among the lineup of the image forming apparatuses that the product provider (manufacturer) provides. Therefore, if the user needs a color copier due to changes in use environment after the user purchased a black and white copier, the user must replace the black and white copier with a color copier or additionally purchase the color copier. This places the economical burden on the user. That is, existing image forming apparatuses cannot flexibly support the user needs.

Therefore, according to the present embodiment, a structure is provided in which a plurality of subsystems having a variety of capabilities (e.g., the paper transport platform 60 and the image forming subsystem 150) can be connected to a basic platform (the engine platform 101). Each of the subsystems includes, for example, a plurality of types of units having different performance (e.g., the feeder unit 70 and the transport unit 80 in the paper transport platform 60, and the image producing unit 170 and the fixing unit 180 in the image forming subsystem 150). The printer engine control unit 105 controls the operations of the subsystems so that a series of image output operations are carried out in parallel or independently.

In such a structure, the subsystem is replaced in accordance with the user needs, serviceability, and expandability so that various subsystems are interchangeably assembled into the platform. Thus, an apparatus that performs a desired image forming operation is achieved. This structure facilitates the system configuration change and the system functionality change in accordance with individual user needs when the user uses the image forming apparatus. Accordingly, a customizable image forming apparatus can be provided to individual users. Furthermore, the latest technology, service, and solution can be provided to the user at an optimal time.

While the foregoing description has been made with reference to an image forming apparatus using an electrophotographic recording method or an electrostatic recording method, the embodiment of the present invention is also applicable to an image forming apparatus using a recording method other than the electrophotographic recording method. In particular, the exemplary embodiment of the present invention relates to an image forming apparatus having the image forming functionality, paper transport functionality, and control functionality and is suitably applied to a copier, a printer, a multi-function printer, and various image forming apparatuses. Additionally, by changing a platform and combining appropriate subsystems, the number of models of the image forming apparatus can be increased.

Second Exemplary Embodiment

In a second exemplary embodiment, a system in which the printer engine control unit 105 operates on the basis of the same CPU resources as those of the platform control unit 65 is described.

Figure 25:
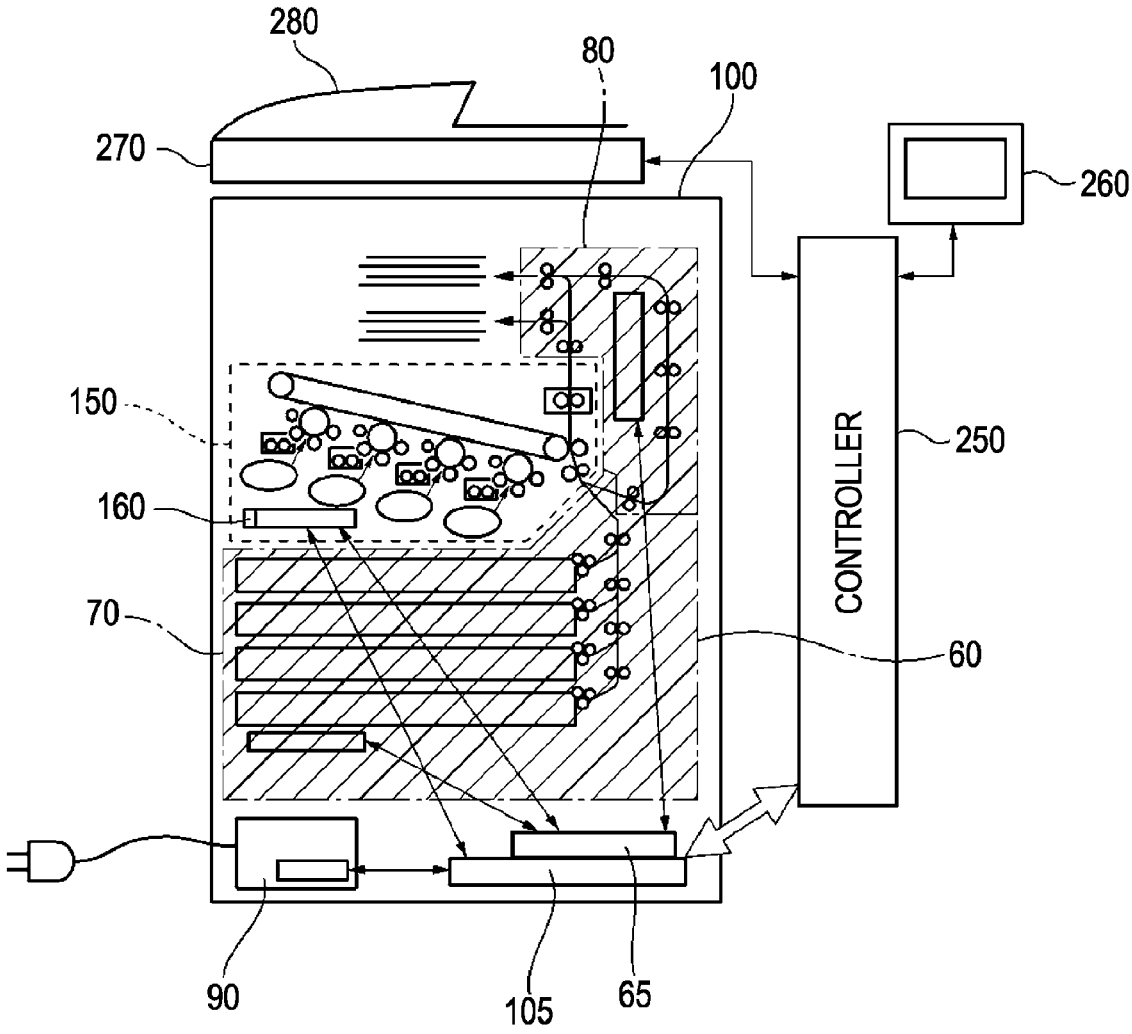
FIG. 25 is an illustration of an exemplary hardware architecture of an image forming apparatus according to a second embodiment of the present invention.
Figure 26:
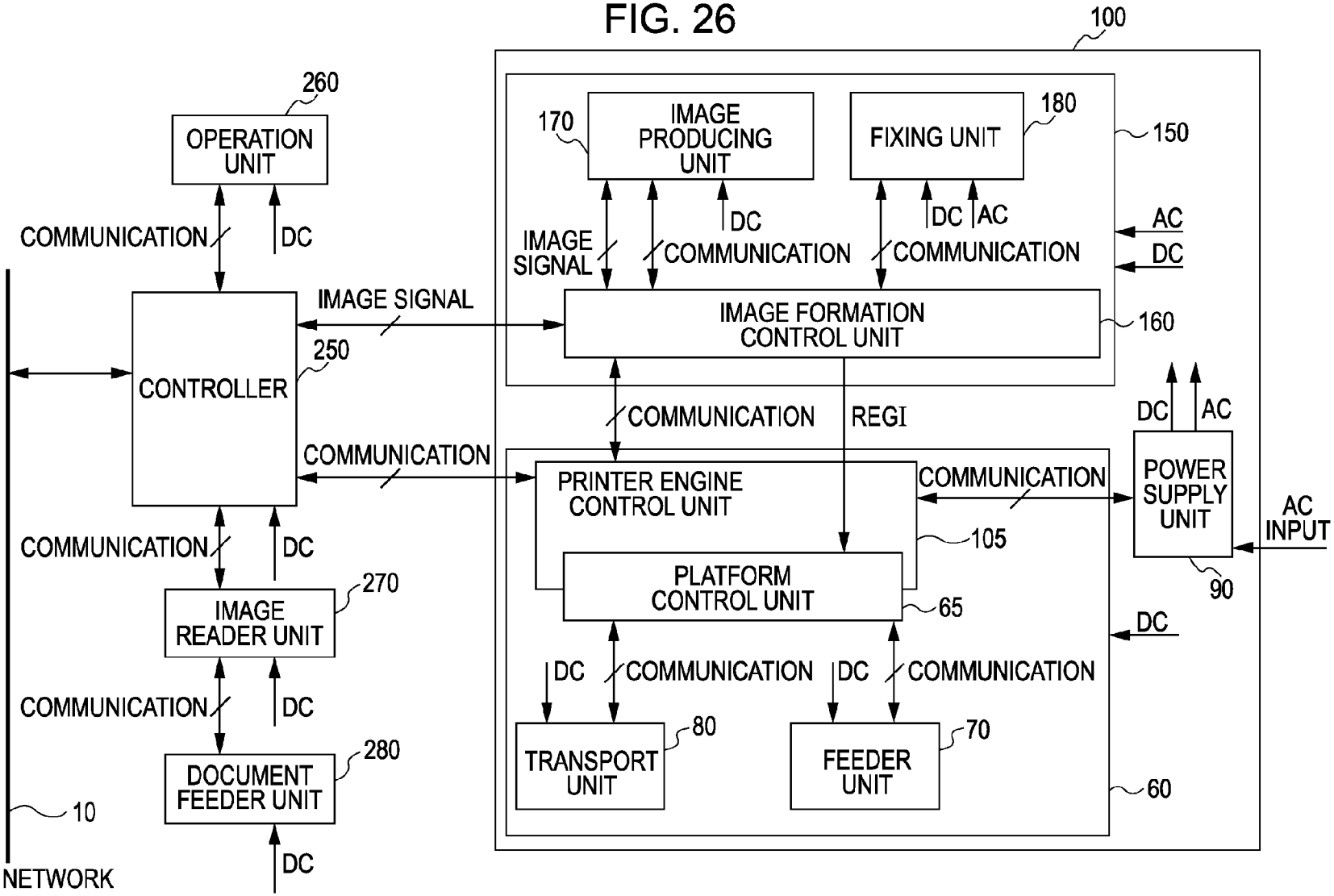
FIG. 26 is a block diagram of the electrical connection of the image forming apparatus according to the second embodiment.

FIG. 25 is an illustration of an exemplary hardware architecture of an image forming apparatus according to the second embodiment of the present invention. FIG. 26 is a block diagram of the electrical connection of an image forming apparatus according to the second embodiment of the present invention.

As shown in FIG. 26, the printer engine control unit 105 manages the control information on a platform control unit 65 included in the printer engine control unit 105, the control information on an image forming subsystem acquired via communication with the image formation control unit 160, and the control information on a power supply unit acquired via communication with a power supply unit 90. For the other components, the connections and controls similar to those described referring to FIGS. 1 and 13 can be applied.

While the foregoing description has been made with reference to a system in which each unit of the paper transport platform 60 and each unit of the image forming subsystem 150 include control units having CPUs and a system in which each unit has no CPUs, the combination of the units having CPUs and units having no CPUs is not limited thereto. This combination can be appropriately determined depending on the control of the units.

In addition, the foregoing description has been made with reference to a system in which the printer engine 100 includes the paper transport platform 60 and the image forming subsystem 150, the paper transport platform 60 includes the feeder unit 70 and the transport unit 80, and the image forming subsystem 150 includes the image producing unit 170 and the fixing unit 180. However, the structure of subsystems in a printer engine, the platform, and the structure of the units in the subsystem are not limited thereto. The structure of the system can be appropriately determined depending on the control of the subsystem and the units.

The second exemplary embodiment can provide the same advantage as that of the first exemplary embodiment. By reexamining the hardware, mechanism, software, and automatic cassette change (ACC) of the subsystems that have different functions and that can be assembled in a base platform, the subsystems can be designed to be interchangeable. The subsystem may include a plurality of units. By replacing the subsystem, a system configuration change, a system functionality change, a service of replacement and examination, and the operation performed by a user and a service person can be efficiently carried out in terms of the user needs, serviceability, and expandability. Additionally, the number of models of the image forming apparatus can be increased so that a plurality of platforms have the compatibility. Thus, the latest technology, service, and solution can be provided to the user at an optimal time. Furthermore, a customizable print system can be provided to the user.

The present invention can also be achieved by supplying a recoding medium storing software program code that achieves the functions of the above-described embodiments to a system or an apparatus and by causing a computer (central processing unit (CPU) or micro-processing unit (MPU)) of the system or apparatus to read and execute the software program code.

In such a case, the program code itself read out of the recording medium realizes the functions of the above-described embodiments. Therefore, the storage medium storing the program code can also realize the present invention.

Examples of the recording medium for supplying the program code include a flexible disk, a hard disk, a magneto optical disk, a CD-ROM (compact disk-read only memory), a CD-R (CD recordable), a CD-RW (CD-rewritable), a DVD-ROM (digital versatile disk-read only memory), a DVD-RAM (DVD-random access memory), a DVD-RW (DVD-rewritable), a DVD+RW (DVD-rewritable), a magnetic tape, a nonvolatile memory card, a ROM (read only memory) or the like. Alternatively, the program code can be downloaded via a network.

Additionally, the functions of the above-described embodiments can be realized by another method in addition to executing the program code read out by the computer. For example, the functions of the above-described embodiments can be realized by a process in which an operating system (OS) running on the computer executes some of or all of the functions in the above-described embodiments under the control of the program code.

The present invention can also be achieved by writing the program code read out of the storage medium to a memory of an add-on expansion board of a computer or a memory of an add-on expansion unit connected to a computer. The functions of the above-described embodiments can be realized by a process in which, after the program code is written, a CPU in the add-on expansion board or in the add-on expansion unit executes some of or all of the functions in the above-described embodiments under the control of the program code.

In such a case, the program code can be supplied directly from the storage medium that stores the program or by downloading from another computer and a database (not shown) connected to the Internet, a commercial network, or a local area network.

The present invention can be applied to a system including a plurality of devices, or to a single-device apparatus. Furthermore, the invention is applicable also to a case where the object of the invention is attained by supplying a program to a system or apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application Nos. 2005-258385 filed Sep. 6, 2005 and 2006-205677 filed Jul. 28, 2006, which are hereby incorporated by reference herein in their entirety.

What is claimed is:

1. An image forming apparatus comprising:

an image forming subsystem including an image bearing member, an exposure unit, a charging unit, and a developing unit, the image forming subsystem being interchangeable;

a sheet transport subsystem configured to transport a sheet medium in the image forming apparatus, the sheet transport subsystem being interchangeable;

a mounting base configured to removably support the image forming subsystem and the sheet transport subsystem;

a control unit configured to control operation of the image forming apparatus;

a guiding mechanism configured to allow each of the image forming subsystem and the sheet transport subsystem to move on the mounting base;

a positioning unit configured to determine the position of the subsystem relative to the mounting base when the subsystem is mounted on the mounting base; and a position detecting unit configured to detect a relative position between the image forming subsystem and the sheet transport subsystem in a condition that that the subsystems are mounted on the mounting base, wherein the mounting base is capable of mounting one of a plurality of the image forming subsystems having different performances and one of a plurality of the sheet transport subsystem having different specifications thereon, wherein the control unit is configured to control the operation of the image forming apparatus in accordance with a combination of the mounted image forming subsystem and the sheet transport subsystem, and wherein the image forming subsystem controls an image forming position based on the detected relative position.

2. The image forming apparatus according to claim 1, wherein each of the image forming subsystem and the sheet transport subsystem includes a plurality of functional units.

3. The image forming apparatus according to claim 2, wherein the plurality of functional units are removably disposed in each of the image forming subsystem and the sheet transport subsystem.

* * * * *